US008373727B2

(12) United States Patent
Furihata et al.

(10) Patent No.: US 8,373,727 B2
(45) Date of Patent: Feb. 12, 2013

(54) DISPLAY APPARATUS AND DISPLAY PANEL DRIVER INCLUDING SUBTRACTIVE COLOR PROCESSING CIRCUIT FOR ERROR DIFFUSION PROCESSING AND WEIGHTING PROCESSING

(75) Inventors: Hirobumi Furihata, Kanagawa (JP); Takashi Nose, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 1317 days.

(21) Appl. No.: 12/149,559

(22) Filed: May 5, 2008

(65) Prior Publication Data

US 2008/0278522 A1 Nov. 13, 2008

(30) Foreign Application Priority Data

May 10, 2007 (JP) ..... 2007-126085

(51) Int. Cl.
*G09G 5/10* (2006.01)

(52) U.S. Cl. ..... 345/690

(58) Field of Classification Search ..... 345/88, 345/690–696

See application file for complete search history.

(56) References Cited

U.S. PATENT DOCUMENTS

2004/0233129 A1* 11/2004 Iwami ..... 345/60
2005/0210338 A1 9/2005 Young

FOREIGN PATENT DOCUMENTS

| | | |
|---|---|---|
| CN | 1950877 A | 4/2007 |
| JP | 9-90902 | 4/1997 |
| JP | 2002-162953 | 6/2002 |
| JP | 2002-251173 | 9/2002 |
| JP | 2002-258805 | 9/2002 |

OTHER PUBLICATIONS

Chinese Office Action dated May 25, 2011, with English translation.

* cited by examiner

*Primary Examiner* — Dennis Joseph
(74) *Attorney, Agent, or Firm* — McGinn IP Law Group, PLLC

(57) ABSTRACT

Disclosed herewith a liquid crystal display apparatus, which includes a liquid crystal display panel that employs the delta arrangement; a subtractive color processing circuit that carries out a subtractive color processing for input image data, thereby generating subtractive color image data; and data line driving circuit that drives the liquid crystal display panel in response to the subtractive color image data. The subtractive color processing circuit carries out a weighting processing that increases or decreases the subtractive color image data according to a line that includes a sub-pixel to be subjected to a subtractive color processing, then carries out an error diffusion processing for the result of the weighting processing, thereby generating subtractive color image data. The subtractive color processing circuit carries out the weighting processing so as to increase the subtractive color image data corresponding to a line and decrease the subtractive color image data corresponding to another line.

7 Claims, 35 Drawing Sheets

FIG. 6B

| INPUT IMAGE DATA $Din^k$ | IMAGE DATA $Dh^k$ WEIGHTED BY WEIGHTING A | IMAGE DATA $Dh^k$ WEIGHTED BY WEIGHTING B |
|---|---|---|
| 0 | 0 | 0 |
| 1 | 2 | 0 |
| 2 | 4 | 0 |
| 3 | 4 | 2 |
| 4 | 4 | 4 |
| 5 | 6 | 4 |
| 6 | 8 | 4 |
| 7 | 8 | 6 |
| ⋮ | ⋮ | ⋮ |
| 248 | 248 | 248 |
| 249 | 250 | 248 |
| 250 | 252 | 248 |
| 251 | 252 | 250 |
| 252 | 252 | 252 |
| 253 | 254 | 252 |
| 254 | 255 | 252 |
| 255 | 255 | 254 |

FIG. 8

| | | R | | G | | B | |
|---|---|---|---|---|---|---|---|
| FRAME | LINE [1:0] | INITIAL VALUE | WEIGHT | INITIAL VALUE | WEIGHT | INITIAL VALUE | WEIGHT |
| 0 | 0 | 2 | A | 0 | B | 2 | A |
| | 1 | 2 | B | 0 | A | 0 | B |
| | 2 | 0 | A | 2 | B | 0 | A |
| | 3 | 0 | B | 2 | A | 2 | B |
| 1 | 0 | 0 | A | 2 | B | 0 | A |
| | 1 | 0 | B | 2 | A | 2 | B |
| | 2 | 2 | A | 0 | B | 2 | A |
| | 3 | 2 | B | 0 | A | 0 | B |
| 2 | 0 | 2 | B | 0 | A | 0 | B |
| | 1 | 0 | A | 2 | B | 0 | A |
| | 2 | 0 | B | 2 | A | 2 | B |
| | 3 | 2 | A | 0 | B | 2 | A |
| 3 | 0 | 0 | B | 2 | A | 2 | B |
| | 1 | 2 | A | 0 | B | 2 | A |
| | 2 | 2 | B | 0 | A | 0 | B |
| | 3 | 0 | A | 2 | B | 0 | A |

FIG. 12A

WEIGHTING A

| Din [1:0] | | Dhlsb [2:0] |
|---|---|---|
| 0 | → | 0 |
| 1 | → | 2 |
| 2 | → | 2 |
| 3 | → | 4 |

WEIGHTING B

| Din [1:0] | | Dhlsb [2:0] |
|---|---|---|
| 0 | → | 0 |
| 1 | → | 0 |
| 2 | → | 2 |
| 3 | → | 2 |

FIG. 12B

| INPUT IMAGE DATA $Din^k$ | IMAGE DATA $Dh^k$ WEIGHTED BY WEIGHTING A | IMAGE DATA $Dh^k$ WEIGHTED BY WEIGHTING B |
|---|---|---|
| 0 | 0 | 0 |
| 1 | 2 | 0 |
| 2 | 2 | 2 |
| 3 | 4 | 2 |
| 4 | 4 | 4 |
| 5 | 6 | 4 |
| 6 | 6 | 6 |
| 7 | 8 | 6 |
| ⋮ | ⋮ | ⋮ |
| 248 | 248 | 248 |
| 249 | 250 | 248 |
| 250 | 250 | 250 |
| 251 | 252 | 250 |
| 252 | 252 | 252 |
| 253 | 254 | 252 |
| 254 | 254 | 254 |
| 255 | 255 | 254 |

FIG. 13

IN CASE OF COLOR REDUCTION BY 3 bits

WEIGHTING A

| Din [2:0] | | Dhlsb [3:0] |
|---|---|---|
| 0 | → | 0 |
| 1 | → | 2 |
| 2 | → | 4 |
| 3 | → | 6 |
| 4 | → | 8 |
| 5 | → | 8 |
| 6 | → | 8 |
| 7 | → | 8 |

WEIGHTING B

| Din [2:0] | | Dhlsb [3:0] |
|---|---|---|
| 0 | → | 0 |
| 1 | → | 0 |
| 2 | → | 0 |
| 3 | → | 0 |
| 4 | → | 0 |
| 5 | → | 2 |
| 6 | → | 4 |
| 7 | → | 6 |

FIG. 14

| | | R | | G | | B | |
|---|---|---|---|---|---|---|---|
| FRAME | LINE [1:0] | INITIAL VALUE | WEIGHT | INITIAL VALUE | WEIGHT | INITIAL VALUE | WEIGHT |
| 0 | 0 | 0 | A | 4 | B | 2 | A |
| | 1 | 0 | B | 4 | A | 2 | B |
| | 2 | 2 | A | 6 | B | 4 | A |
| | 3 | 2 | B | 6 | A | 4 | B |
| | 4 | 4 | A | 0 | B | 6 | A |
| | 5 | 4 | B | 0 | A | 6 | B |
| | 6 | 6 | A | 2 | B | 0 | A |
| | 7 | 6 | B | 2 | A | 0 | B |
| 1 | 0 | 0 | B | 4 | A | 2 | B |
| | 1 | 0 | A | 4 | B | 2 | A |
| | 2 | 2 | B | 6 | A | 4 | B |
| | 3 | 2 | A | 6 | B | 4 | A |
| | 4 | 4 | B | 0 | A | 6 | B |
| | 5 | 4 | A | 0 | B | 6 | A |
| | 6 | 6 | B | 2 | A | 0 | B |
| | 7 | 6 | A | 2 | B | 0 | A |
| 2 | 0 | 4 | A | 0 | B | 6 | B |
| | 1 | 4 | B | 0 | A | 6 | A |
| | 2 | 6 | A | 2 | B | 0 | B |
| | 3 | 6 | B | 2 | A | 0 | A |
| | 4 | 0 | A | 4 | B | 2 | B |
| | 5 | 0 | B | 4 | A | 2 | A |
| | 6 | 2 | A | 6 | B | 4 | B |
| | 7 | 2 | B | 6 | A | 4 | A |
| 3 | 0 | 4 | B | 0 | A | 6 | A |
| | 1 | 4 | A | 0 | B | 6 | B |
| | 2 | 6 | B | 2 | A | 0 | A |
| | 3 | 6 | A | 2 | B | 0 | B |
| | 4 | 0 | B | 4 | A | 2 | A |
| | 5 | 0 | A | 4 | B | 2 | B |
| | 6 | 2 | B | 6 | A | 4 | A |
| | 7 | 2 | A | 6 | B | 4 | B |
| 4 | 0 | 2 | A | 6 | B | 4 | B |
| | 1 | 2 | B | 6 | A | 4 | A |
| | 2 | 4 | A | 0 | B | 6 | B |
| | 3 | 4 | B | 0 | A | 6 | A |
| | 4 | 6 | A | 2 | B | 0 | B |
| | 5 | 6 | B | 2 | A | 0 | A |
| | 6 | 0 | A | 4 | B | 2 | B |
| | 7 | 0 | B | 4 | A | 2 | A |
| 5 | 0 | 2 | B | 6 | A | 4 | B |
| | 1 | 2 | A | 6 | B | 4 | A |
| | 2 | 4 | B | 0 | A | 6 | B |
| | 3 | 4 | A | 0 | B | 6 | A |
| | 4 | 6 | B | 2 | A | 0 | B |
| | 5 | 6 | A | 2 | B | 0 | A |
| | 6 | 0 | B | 4 | A | 2 | B |
| | 7 | 0 | A | 4 | B | 2 | A |
| 6 | 0 | 6 | A | 2 | B | 0 | A |
| | 1 | 6 | B | 2 | A | 0 | B |
| | 2 | 0 | A | 4 | B | 2 | A |
| | 3 | 0 | B | 4 | A | 2 | B |
| | 4 | 2 | A | 6 | B | 4 | A |
| | 5 | 2 | B | 6 | A | 4 | B |
| | 6 | 4 | A | 0 | B | 6 | A |
| | 7 | 4 | B | 0 | A | 6 | B |
| 7 | 0 | 6 | B | 2 | A | 0 | B |
| | 1 | 6 | A | 2 | B | 0 | A |
| | 2 | 0 | B | 4 | A | 2 | B |
| | 3 | 0 | A | 4 | B | 2 | A |
| | 4 | 2 | B | 6 | A | 4 | B |
| | 5 | 2 | A | 6 | B | 4 | A |
| | 6 | 4 | B | 0 | A | 6 | B |
| | 7 | 4 | A | 0 | B | 6 | A |

FIG. 16

WEIGHTING DATA VALUE A

| Din [3:0] | | Dhlsb [4:0] |
|---|---|---|
| 0 | → | 0 |
| 1 | → | 2 |
| 2 | → | 4 |
| 3 | → | 6 |
| 4 | → | 8 |
| 5 | → | 10 |
| 6 | → | 12 |
| 7 | → | 14 |
| 8 | → | 16 |
| 9 | → | 16 |
| 10 | → | 16 |
| 11 | → | 16 |
| 12 | → | 16 |
| 13 | → | 16 |
| 14 | → | 16 |
| 15 | → | 16 |

WEIGHTING DATA VALUE B

| Din [3:0] | | Dhlsb [4:0] |
|---|---|---|
| 0 | → | 0 |
| 1 | → | 0 |
| 2 | → | 0 |
| 3 | → | 0 |
| 4 | → | 0 |
| 5 | → | 0 |
| 6 | → | 0 |
| 7 | → | 0 |
| 8 | → | 0 |
| 9 | → | 2 |
| 10 | → | 4 |
| 11 | → | 6 |
| 12 | → | 8 |
| 13 | → | 10 |
| 14 | → | 12 |
| 15 | → | 14 |

FIG. 19A

| | | R | | G | | B | |
|---|---|---|---|---|---|---|---|
| FRAME | LINE [1:0] | INITIAL VALUE | WEIGHT | INITIAL VALUE | WEIGHT | INITIAL VALUE | WEIGHT |
| 0 | 0 | 2 | A | 0 | B | 3(2) | A |
| | 1 | 3(2) | B | 1(0) | A | 0 | B |
| | 2 | 0 | A | 2 | B | 1(0) | A |
| | 3 | 1(0) | B | 3(2) | A | 2 | B |
| 1 | 0 | 0 | A | 2 | B | 1(0) | A |
| | 1 | 1(0) | B | 3(2) | A | 2 | B |
| | 2 | 2 | A | 0 | B | 3(2) | A |
| | 3 | 3(2) | B | 1(0) | A | 0 | B |
| 2 | 0 | 3(2) | B | 1(0) | A | 0 | B |
| | 1 | 0 | A | 2 | B | 1(0) | A |
| | 2 | 1(0) | B | 3(2) | A | 2 | B |
| | 3 | 2 | A | 0 | B | 3(2) | A |
| 3 | 0 | 1(0) | B | 3(2) | A | 2 | B |
| | 1 | 2 | A | 0 | B | 3(2) | A |
| | 2 | 3(2) | B | 1(0) | A | 0 | B |
| | 3 | 0 | A | 2 | B | 1(0) | A |

FIG. 19B

| | | R | | G | | B | |
|---|---|---|---|---|---|---|---|
| FRAME | LINE [1:0] | INITIAL VALUE | WEIGHT | INITIAL VALUE | WEIGHT | INITIAL VALUE | WEIGHT |
| 0 | 0 | 2 | - | 0 | - | 3 | - |
| | 1 | 3 | - | 1 | - | 0 | - |
| | 2 | 0 | - | 2 | - | 1 | - |
| | 3 | 1 | - | 3 | - | 2 | - |
| 1 | 0 | 0 | - | 2 | - | 1 | - |
| | 1 | 1 | - | 3 | - | 2 | - |
| | 2 | 2 | - | 0 | - | 3 | - |
| | 3 | 3 | - | 1 | - | 0 | - |
| 2 | 0 | 3 | - | 1 | - | 0 | - |
| | 1 | 0 | - | 2 | - | 1 | - |
| | 2 | 1 | - | 3 | - | 2 | - |
| | 3 | 2 | - | 0 | - | 3 | - |
| 3 | 0 | 1 | - | 3 | - | 2 | - |
| | 1 | 2 | - | 0 | - | 3 | - |
| | 2 | 3 | - | 1 | - | 0 | - |
| | 3 | 0 | - | 2 | - | 1 | - |

FIG. 22

Dh1 INITIAL VALUE

| FRAME | LINE [1:0] | R INITIAL VALUE | G INITIAL VALUE | B INITIAL VALUE |
|---|---|---|---|---|
| 0,1 | 0 | 2 | 0 | 3 |
| | 1 | 3 | 1 | 0 |
| | 2 | 0 | 2 | 1 |
| | 3 | 1 | 3 | 2 |
| 2,3 | 0 | 0 | 2 | 1 |
| | 1 | 1 | 3 | 2 |
| | 2 | 2 | 0 | 3 |
| | 3 | 3 | 1 | 0 |
| 4,5 | 0 | 3 | 1 | 0 |
| | 1 | 0 | 2 | 1 |
| | 2 | 1 | 3 | 2 |
| | 3 | 2 | 0 | 3 |
| 6,7 | 0 | 1 | 3 | 2 |
| | 1 | 2 | 0 | 3 |
| | 2 | 3 | 1 | 0 |
| | 3 | 0 | 2 | 1 |

(Dh1 INITIAL VALUE+2)%4 →

Dh2 INITIAL VALUE

| FRAME | LINE [1:0] | R INITIAL VALUE | G INITIAL VALUE | B INITIAL VALUE |
|---|---|---|---|---|
| 0,1 | 0 | 0 | 2 | 1 |
| | 1 | 3 | 1 | 2 |
| | 2 | 0 | 2 | 3 |
| | 3 | 1 | 3 | 0 |
| 2,3 | 0 | 2 | 0 | 3 |
| | 1 | 3 | 1 | 0 |
| | 2 | 0 | 2 | 1 |
| | 3 | 1 | 3 | 2 |
| 4,5 | 0 | 1 | 3 | 2 |
| | 1 | 2 | 0 | 3 |
| | 2 | 3 | 1 | 0 |
| | 3 | 0 | 2 | 1 |
| 6,7 | 0 | 3 | 1 | 0 |
| | 1 | 0 | 2 | 1 |
| | 2 | 1 | 3 | 2 |
| | 3 | 2 | 0 | 3 |

FIG. 24B

VALUE OF INPUT IMAGE DATA $Din^G$

| 1 | 1 | 1 | 1 | 2 | 2 | 2 | 2 | 3 | 3 | 3 | 3 | 0 | 0 |
|---|---|---|---|---|---|---|---|---|---|---|---|---|---|

| FRAME | | OUTPUT VALUE | | | | | | | | | | | | | |
|---|---|---|---|---|---|---|---|---|---|---|---|---|---|---|---|
| 0,1 | Dh1 | 0 | 0 | 0 | 1 | 0 | 1 | 0 | 1 | 0 | 1 | 1 | 1 | 0 | 0 |
| | Dh2 | 0 | 1 | 0 | 0 | 1 | 0 | 1 | 0 | 1 | 1 | 0 | 1 | 0 | 0 |
| 2,3 | Dh1 | 0 | 0 | 1 | 0 | 0 | 1 | 0 | 1 | 1 | 0 | 1 | 1 | 0 | 0 |
| | Dh2 | 1 | 0 | 0 | 0 | 1 | 0 | 1 | 0 | 1 | 1 | 1 | 0 | 0 | 0 |
| 4,5 | Dh1 | 0 | 1 | 0 | 0 | 1 | 0 | 1 | 0 | 1 | 1 | 0 | 1 | 0 | 0 |
| | Dh2 | 0 | 0 | 0 | 1 | 0 | 1 | 0 | 1 | 0 | 1 | 1 | 1 | 0 | 0 |
| 6,7 | Dh1 | 1 | 0 | 0 | 0 | 1 | 0 | 1 | 0 | 1 | 1 | 1 | 0 | 0 | 0 |
| | Dh2 | 0 | 0 | 1 | 0 | 0 | 1 | 0 | 1 | 1 | 0 | 1 | 1 | 0 | 0 |

VALUE OF LOWER ORDER BIT OUTPUT $Dh^G$ (ZEROTH_LINE)

| | | | | | | | | | | | | | | | |
|---|---|---|---|---|---|---|---|---|---|---|---|---|---|---|---|
| ZEROTH FRAME | 0 | 1 | 0 | 1 | 1 | 1 | 1 | 1 | 1 | 1 | 1 | 1 | 0 | 0 |
| FIRST FRAME | 0 | 0 | 0 | 0 | 0 | 0 | 0 | 0 | 0 | 1 | 0 | 1 | 0 | 0 |
| SECOND FRAME | 1 | 0 | 1 | 0 | 1 | 1 | 1 | 1 | 1 | 1 | 1 | 1 | 0 | 0 |
| THIRD FRAME | 0 | 0 | 0 | 0 | 0 | 0 | 0 | 0 | 1 | 0 | 1 | 0 | 0 | 0 |
| FOURTH FRAME | 0 | 0 | 0 | 0 | 0 | 0 | 0 | 0 | 0 | 1 | 0 | 1 | 0 | 0 |
| FIFTH FRAME | 0 | 1 | 0 | 1 | 1 | 1 | 1 | 1 | 1 | 1 | 1 | 1 | 0 | 0 |
| SIX FRAME | 0 | 0 | 0 | 0 | 0 | 0 | 0 | 0 | 1 | 0 | 1 | 0 | 0 | 0 |
| SEVENTH FRAME | 1 | 0 | 1 | 0 | 1 | 1 | 1 | 1 | 1 | 1 | 1 | 1 | 0 | 0 |

+0 GRADATION OUTPUT

+1 GRADATION OUTPUT

DISPLAY APPARATUS AND DISPLAY PANEL DRIVER INCLUDING SUBTRACTIVE COLOR PROCESSING CIRCUIT FOR ERROR DIFFUSION PROCESSING AND WEIGHTING PROCESSING

BACKGROUND OF THE INVENTION

1. Field of the Invention

The present invention relates to a driving method to be employed for display apparatuses and display panels, more particularly to a display panel configured so as to carry out a subtractive color processing upon driving its display panel that employs the delta arrangement, as well as a driving technique to be employed for the display panel configured such way.

2. Description of Related Art

The stripe arrangement and the delta arrangement are the two methods employed most frequently for disposing sub-pixels in each pixel in LCD (liquid crystal display) panels. FIG. 1 shows a configuration of an LCD panel that employs the stripe arrangement and FIG. 2 shows a configuration of an LCD panel that employs the delta arrangement.

As shown in FIG. 1, in case of the LCD panel that employs the stripe arrangement, one pixel consists of three sub-pixels that represent red (R), green (G), and blue (B) colors respectively and are disposed side by side in a line in the horizontal direction. The same color sub-pixels are disposed linearly and adjacently in the vertical direction. In the following description, red, green, and blue sub-pixels will be referred to as R sub-pixels, G sub-pixels, and B sub-pixels respectively. In case of the stripe arrangement, each pixel consisting of three sub-pixels (R, G, and B sub-pixels) is square in shape.

On the other hand, as shown in FIG. 2, in case of the LCD panel that employs the delta arrangement, each pixel consists of an R sub-pixel, a G sub-pixel, and a B sub-pixel that are disposed to form a triangle and the center of each of those sub-pixels is positioned at the peak of such a triangle. Furthermore, in case of the LCD panel that employs the delta arrangement, each pixel is disposed over two lines. In case of the LCD panel that employs the delta arrangement, same color sub-pixels are disposed side by side in a zigzag pattern. For example, in case of the G sub-pixels on the first line and the G sub-pixels on the second line that is adjacent to the first line, the G sub-pixels on the second line are shifted from the G sub-pixels on the first line by one and a half sub-pixels in the horizontal direction. This is similar to the red and blue sub-pixels. In case of the LCD panel that employs the delta arrangement, the three sub-pixels (R, G, and B sub-pixels) disposed side by side in the horizontal direction come to form a rectangle in a general view and this point in the delta arrangement differs from the stripe arrangement.

Note that, however, same color sub-pixels are connected to one data line even in case of the delta arrangement. For example, in case of the disposition example shown in FIG. 2, the G sub-pixels of G2, G3, and G1 are connected to a common data line and no R and B sub-pixels are connected to the data line. Similarly, the G sub-pixels of G4, G7, and G5 are connected to another common data line and no E and B sub-pixels are connected to the data line.

Upon driving an LCD panel, a subtractive color processing is carried out for display data in some cases regardless of the pixel arrangement method (delta or stripe) employed for the display panel. The subtractive color processing means a processing that generates n-bit subtractive color image data (n<m) from the original m-bit image data without degrading the image as far as possible. This processing is employed widely to realize multilevel gradation display by getting over hardware restrictions.

There is another method employed most widely; it is the error diffusion processing. The error diffusion processing uses an algorithm that determines the subtractive color image data of an object sub-pixel according to an error between input image data of another sub-pixel adjacent to the former sub-pixel and the subtractive color image data. For example, the algorithm is disclosed by JP-A-09-090902, JP-A-2002-162953, JP-A-2002-251173, and JP-A-2002-258805, respectively. FIG. 3 shows an example of a subtractive color processing circuit that carries out an error diffusion processing to generate 6-bit subtractive color image data Dfrc from 8-bit input image data Din. The subtractive color processing circuit shown in FIG. 3 generates the subtractive color image data Dfrc of a single sub-pixel in one clock cycle of the dot clock signal DCL.

The subtractive color processing circuit shown in FIG. 3 includes addition circuits 101 and 102, a D latch circuit 103, a selector circuit 104, and an initial value setting circuit 105. The D latch circuit 103 holds the error Derr of an object sub-pixel. The initial value setting circuit 105 supplies the initial value DerrINI of the error used in an error diffusion processing. The initial value setting circuit 105 holds a frame count denoting the number of an object frame to be subjected to a subtractive color processing and a line count denoting the number of an object line. The initial value DerrINI generated by the initial value setting circuit 105 differs among frames and lines respectively.

The subtractive color processing circuit shown in FIG. 3 operates as follows.

At first, the selector 104 supplies either the initial value DerrINI generated by the initial value setting circuit 105 or the error Derr held in the D latch 103 to the addition circuit 102 according to the initial error value read signal DE_POS. Concretely, in the error diffusion processing for the first sub-pixel of each line to be processed, "1" is set in the initial error value read signal DE_POS, so that the selector 104 supplies the initial value DerrINI to the addition circuit 102. On the other hand, in the error diffusion processing for each of other sub-pixels, "0" is set in the initial error value read signal DE_POS, so that the selector 104 supplies the error Derr held in the D latch 103 to the addition circuit 102.

The addition circuit 102 adds up the lower-order 2 bits of the input image data Din and the error Derr (or the initial value DerrINI) to obtain a carry output cry and an error DerrN used in the error diffusion processing for a sub-pixel from which the next subtractive color image data Dfrc is calculated. The D latch 103 is triggered by the dot clock signal DLC to latch the error DerrN output from the addition circuit 102 and update the error Derr. The addition circuit 101 adds up the upper-order 6 bits of the input image data Din and the carry output cry of the addition circuit 102 to generate the subtractive color image data Dfrc of the object sub-pixel.

The error diffusion processing that generates the subtractive color image data Dfrc such way depends on the original image data, thereby causing the position of each high luminance sub-pixel to be changed. This is why the processing can suppress the generation of peculiar patterns that might cause screen flickering.

SUMMARY

However, the present inventor has found that the delta arrangement employed for an LCD panel has been confronted with a problem of screen flickering that looks like luminance unevenness of vertical stripes. FIG. 4 shows an example for describing the reasons why such a problem occurs with reference to an image in which "0" is set for the image data consisting of red (R) and blue (B) sub-pixels respectively and a prescribed value (e.g., "2") is set for the image data consisting of a green (G) sub-pixel. In FIG. 4, note that each thin hatching portion denotes relatively low luminance and each dark hatching portion denotes relatively high luminance.

As illustrated at the left side in FIG. 4, in case of the stripe arrangement, if an error diffusion processing is carried out for color subtraction, relatively high luminance G sub-pixels and relatively low luminance G sub-pixels are disposed alternately on the same line. Furthermore, in the error diffusion processing, the initial error value is changed for each line, so that relatively high luminance sub-pixels and relatively low luminance sub-pixels are disposed alternately even in the vertical direction. As a result, in case of the stripe arrangement, each G sub-pixel adjacent to a high luminance G pixel is low in luminance. For example, the G sub-pixels G1 and G2 closest to the relatively high luminance G pixel G0 respectively are low in luminance.

On the other hand, as illustrated at the right side in FIG. 4, in case of the delta arrangement, even when the same error diffusion processing as that of the stripe arrangement is carried out, both high luminance areas and low luminance areas are generated, thereby causing screen flickering. This is because the color subtraction carried out in an error diffusion processing for an LCD panel that employs the delta arrangement causes a plurality of high luminance G sub-pixels to be adjacent most closely to each another. For example, take a look at the G sub-pixel G0 illustrated at the right side in FIG. 4. The four G sub-pixels G1 to G4 are adjacent to the G sub-pixel G0 most closely. And the G sub-pixels G1 and G2 are high luminance sub-pixels just like the G sub-pixel G0. Consequently, the area enclosed by a broken line in FIG. 4 is observed as a high luminance area in a general view. This is why the area is recognized as uneven luminance vertical stripes. Furthermore, if the places of the high luminance area and the low luminance area are changed due to the initial value that is changed for each frame, the user will come to recognize the result as screen flickering of vertical stripes.

According to one aspect, the display apparatus of the present invention includes a display panel in which a plurality of pixels, each of pixels having a plurality of sub-pixels which are disposed according to the delta arrangement; a subtractive color processing circuit that carries out a subtractive color processing for input image data denoting a gradation of those sub-pixels, thereby generating subtractive color image data (Dfrc); and a driving circuit that drives the display panel in response to the subtractive color image data. The subtractive color processing carries out an error diffusion processing and a weighting processing to generate the subtractive color data that is increased or decreased in accordance with a line that includes the sub-pixel to be subjected to the subtractive color processing. The subtractive color processing carries out the weighting processing so as to increase the subtractive color data corresponding to each object sub-pixel belonging to a line and decrease the subtractive color data corresponding to each object sub-pixel belonging to another line adjacent to the line.

In case of the display apparatus configured such way, a weighting processing can increase the luminance of the sub-pixels of some of lines and decrease the luminance of the sub-pixels of the other of line, so that the bias of luminance among sub-pixels, which is caused by the panel structure, can be eased, thereby screen flickering can be suppressed. Concretely, in case of a display panel that employs the delta arrangement, each sub-pixel is positioned farther from the same color sub-pixels on the same line than the same color sub-pixels disposed adjacently in the vertical direction. Consequently, ordinary error diffusion processings are apt to cause the luminance to be one-sided in the vertical direction. In case of the display apparatus of the present invention, however, weighting processings are carried out to suppress such one-sided luminance in the vertical direction, thereby the screen flickering is suppressed.

According to another aspect, the display panel driver of the present invention drives a display panel having a plurality of pixels, each of pixels having a plurality of sub-pixels. The display panel driver of the present invention includes a subtractive color processing circuit that carries out a subtractive color processing for input image data denoting a gradation of the plurality of sub-pixels respectively, thereby generating subtractive color data and a driving circuit (18) that drives the display panel in response to the subtractive color data. The subtractive color processing carries out an error diffusion processing and a weighting processing to generate the subtractive color data that is increased or decreased in accordance with the line including each object sub-pixel to be subjected to the subtractive color processing. The subtractive color processing carries out the weighting processing so as to increase the subtractive color data corresponding to each sub-pixel belonging to a line and decrease the subtractive color data corresponding to each sub-pixel belonging to another line adjacent to the line. The driver of the display panel configured such way can thus suppress the screen flickering to be caused by the unevenness of luminance upon driving the display panel (2) that employs the delta arrangement.

According to still another aspect, the display panel driver of the present invention drives a display panel having a plurality of pixels, each of pixels having a plurality of sub-pixels. The display panel driver includes a subtractive color processing circuit that carries out a subtractive color processing for input image data denoting a gradation of the plurality of sub-pixels respectively, thereby generating subtractive color image data and a driving circuit (18) that drives the display panel in response to the subtractive color image data. The subtractive color processing circuit carries out a subtractive color processing to generate the subtractive color image data in response to a control signal denoting whether the display panel employs the delta arrangement or the stripe arrangement. The content of the subtractive color processing differs between the delta arrangement and the stripe arrangement.

According to the knowledge of the present inventor, an optimal subtractive color processing should be determined according to whether the display panel employs the delta arrangement or the stripe arrangement. The display panel driver (3A, 3C) thus carries out a subtractive color processing selected according to whether the display panel employs the delta arrangement or the stripe arrangement, thereby the display panel can display images with favorable image quality regardless of the employed arrangement of pixels.

According to the present invention, therefore, it is possible to suppress the screen flickering to be caused by the unevenness of luminance upon driving the display panel that employs the delta arrangement.

BRIEF DESCRIPTION OF THE DRAWINGS

The above and other objects, advantages and features of the present invention will be more apparent from the following description of certain preferred embodiments taken in conjunction with the accompanying drawings, in which:

FIG. 6B is a table that shows a relationship between input image data and weighted image data generated by a weighting processing in the first embodiment;

FIG. 8 is a table that shows a relationship between the weighting type selected by the weighting circuit and the initial error values used in error diffusion processings;

FIG. 12A is a diagram that describes another weighting type usable in the first embodiment;

FIG. 12B is a table that shows a relationship between input image data and weighted image data generated by the weighting types respectively shown in FIG. 12A;

FIG. 13 is a diagram that describes an example of the weighting processing in case of a 3-bit subtractive color processing carried out in the first embodiment;

FIG. 14 is a table that shows a relationship between the weighting type selected by the weighting circuit and the initial error values used in the error diffusion processing in case of a 3-bit subtractive color processing carried out in the first embodiment;

FIG. 16 is a diagram that describes an example of the weighting processing in case of a 4-bit subtractive color processing carried out in the first embodiment;

FIG. 19A is a table that shows a relationship between the weighting type "A"/"B" selected by the weighting circuit and the initial error values used in the error diffusion processing in case of driving the liquid crystal display panel that employs the delta arrangement in the second embodiment;

FIG. 19B is a table that shows a relationship between the weighting type "A"/"B" selected by the weighting circuit and the initial error values used in the error diffusion processing in case of driving the liquid crystal display panel that employs the stripe arrangement in the second embodiment;

FIG. 22 is a table that shows initial error values used in the error diffusion processings in the third embodiment;

FIG. 24B is a table that shows an example of operations of the subtractive color processing circuit in the third embodiment;

DETAILED DESCRIPTION OF THE PREFERRED EMBODIMENTS

Figure 1:
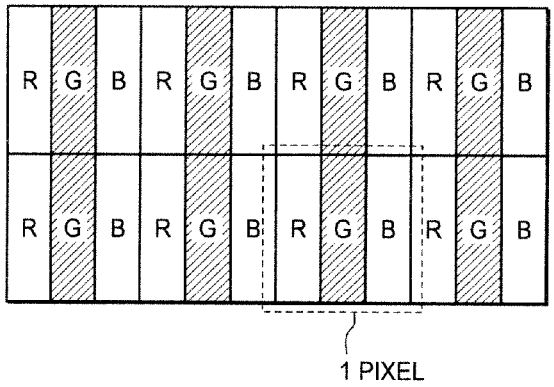
RELATED ART FIG. 1
FIG. 1 is a concept diagram that shows a configuration of a liquid crystal display panel that employs the stripe arrangement.

The invention will be now described herein with reference to illustrative embodiments. Those skilled in the art will recognize that many alternative embodiments can be accomplished using the teachings of the present invention and that the invention not limited to the embodiments illustrated for explanatory purposes. In those accompanying drawings, the same or similar reference numerals will be used for the same or similar components to avoid redundant description.

(First Embodiment)

Figure 5A:
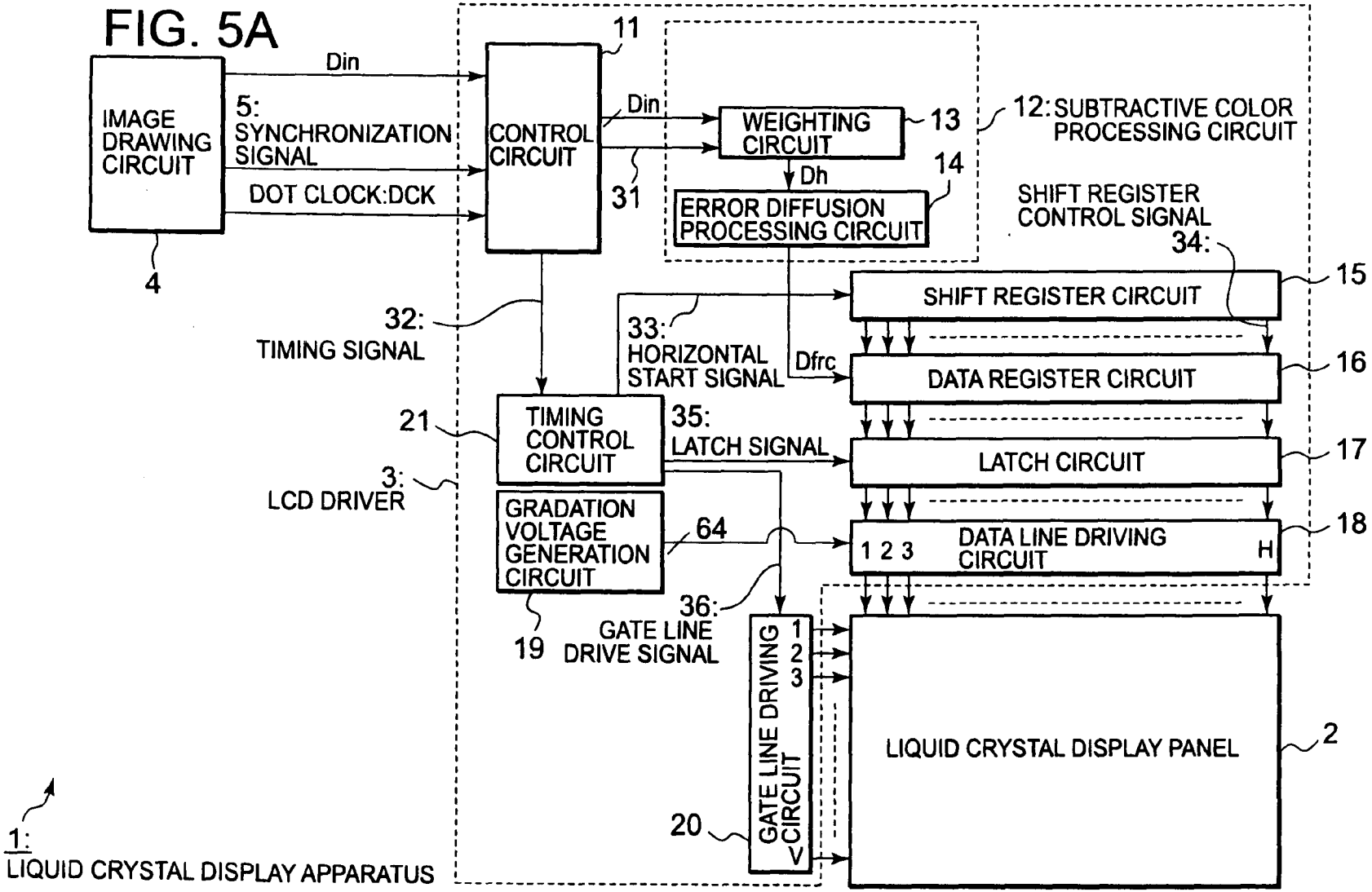
FIG. 5A is a block diagram of a liquid crystal display apparatus with respect to its configuration in a first embodiment of the present invention.

FIG. 5A shows a block diagram of a liquid crystal display apparatus 1 with respect to its a configuration in this first embodiment of the present invention. The liquid crystal display apparatus 1 in this first embodiment includes a liquid crystal display panel 2 and an LCD driver 3.

In the liquid crystal display panel 2 are formed many pixels, each being composed of three sub-pixels (R, G, and B sub-pixels). Each of those sub-pixels includes a thin film transistor (TFT) and an image electrode and each of the R, G, and B sub-pixels displays its color (red, green, or blue) with prescribed luminance.

The liquid crystal display panel 2 includes H data lines extended in the vertical direction and V gate lines extended in the horizontal direction. Each sub-pixel is provided at an intersecting point between a date line and a gate line. Each data line is connected to same color sub-pixels and drives those connected sub-pixels. The sub-pixels of a line, arranged side by side in the horizontal direction of the liquid crystal display panel 2, are connected to a same gate line and those sub-pixels arranged on a line such way are referred to just as a line.

Figure 2:
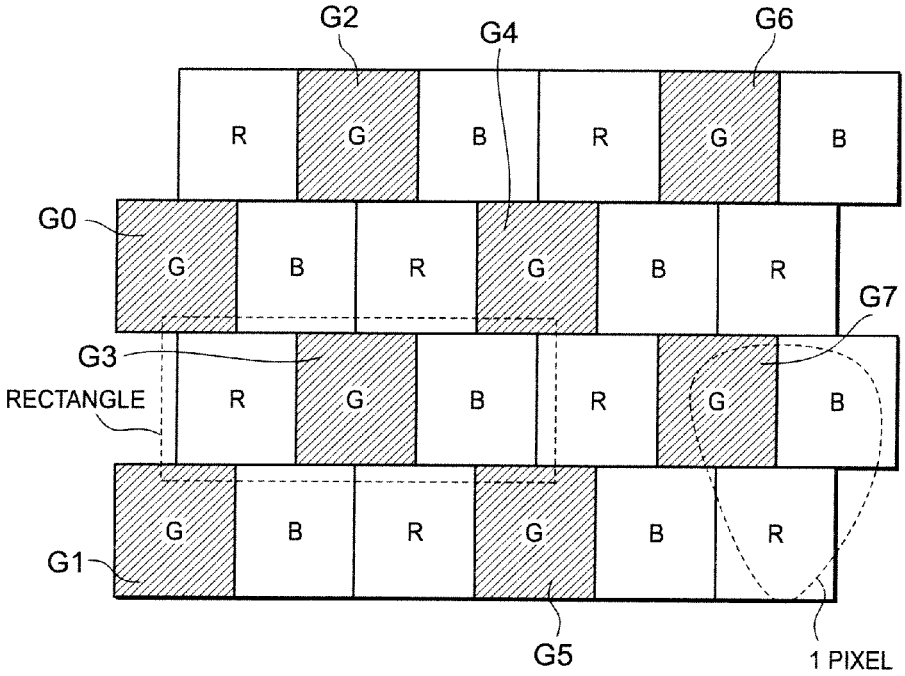
RELATED ART FIG. 2
FIG. 2 is a concept diagram that shows a configuration of a liquid crystal display panel that employs the delta arrangement.
Figure 3:
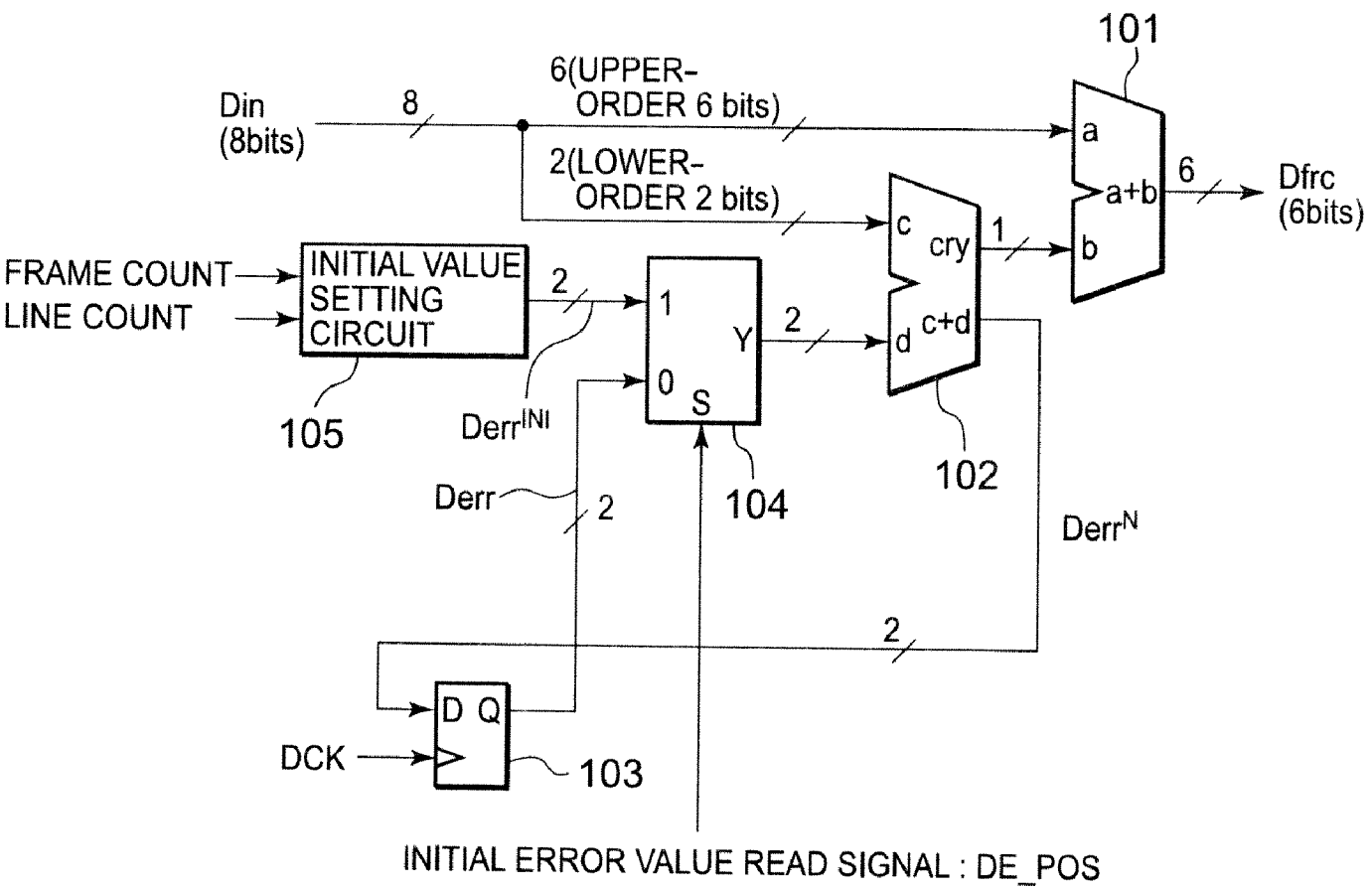
RELATED ART FIG. 3
FIG. 3 is a block diagram of a typical error diffusion processing circuit with respect to its configuration.
Figure 4:
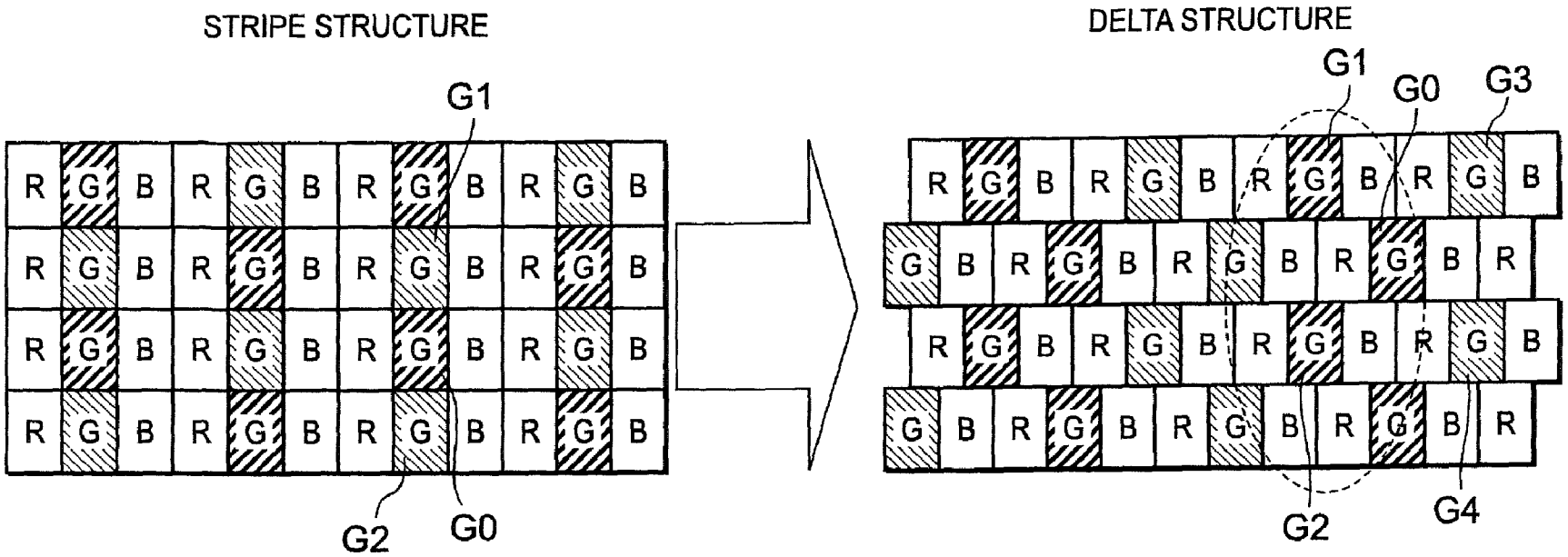
FIG. 4 RELATED ART
FIG. 4 is a concept diagram that describes how screen flickering occurs on the liquid crystal display panel that employs the delta arrangement due to a general error diffusion processing.

The three sub-pixels of each pixel are disposed according to the delta arrangement. This means that one pixel is composed of an R sub-pixel, a G sub-pixel, and a B sub-pixel and the center of each of those three sub-pixels is positioned at the peak of a triangle as shown in FIG. 2. Note that the same color sub-pixels are disposed in a zigzag pattern. For example, look at the G sub-pixels on the first line and the G sub-pixels on the second line adjacent to the first line. The G sub-pixels on the second line are shifted by one and a half sub-pixels in the horizontal direction from the G sub-pixels on the first line. This also goes for the red and blue sub-pixels.

The LCD driver 3 receives input image data Din from external, concretely from an image drawing circuit 4 and drives the data lines of the liquid crystal display panel 2 in response to the input image data Din. The image drawing circuit 4 is, for example, a CPU or DSP (digital signal processor). The input image data Din represents a gradation of a sub-pixel with m bit(s). Hereunder, the input image data Din denoting a gradation of an R sub-pixel might be referred to as input image data DinR, the input image data Din denoting a gradation of a G sub-pixel might be referred to as input image data DinG, and the input image data Din denoting a gradation of a B sub-pixel might be referred to as input image data DinB respectively. In addition, the LCD driver 3 can also drive the gate lines of the liquid crystal display panel 2. The LCD driver 3 is supplied a synchronization signal 5, a dot clock DCK, and other control signals from the image drawing circuit 4. The LCD driver 3 functions in response to those supplied control signals.

The LCD driver 3 includes a control circuit 11, a subtractive color processing circuit 12, a shift register circuit 15, a data register circuit 16 consisting of a plurality of registers, a latch circuit 17 consisting of a plurality of latches, a data line driving circuit 18, a gradation voltage generation circuit 19, a gate line driving circuit 20, and a timing control circuit 21.

The control circuit 11 transfers input image data Din received from the image drawing circuit 4 and supplies a control signal 31 to the subtractive color processing circuit 12. The control signal 31 includes the dot clock signal DCK. And the control circuit 11 generates a timing signal 32 from the synchronization signal 5 and supplies the timing signal 32 to the timing control circuit 21.

The subtractive color processing circuit 12 carries out a subtractive color processing for the m-bit input image data Din to generate the n-bit subtractive color image data Dfrc (m>n). In this first embodiment, the liquid crystal display apparatus 1 is mainly characterized by the subtractive color processing carried out by the subtractive color processing circuit 12. The configurations and operations of the subtractive color processing circuit 12 will be described in detail later.

The shift register circuit 15 is configured as a one-input many-output shift register. The shift register circuit 15 supplies a shift register output signal 34 to each register of the data register circuit 16. The shift register output signal 34 enables each register to receive the subtractive color image data Dfrc. One shift register output signal 34 is supplied to one register. The shift register circuit 15 inputs a horizontal start signal 33 from the timing control circuit 21. When the horizontal start signal 33 is activated (typically pulled up to the "high" level), the shift register circuit 15 activates the shift register output signal 34 and enables the registers of the data register circuit 16 sequentially to receive the subtractive color image data Dfrc respectively.

The data register circuit 16 consists of a plurality of registers and receives subtractive color image data Dfrc sequentially from the subtractive color processing circuit 12 and stores those data in its registers. The number of the registers of the data register circuit 16 is determined so as to store the subtractive color image data Dfrc enough to drive the sub-pixels of one line of the liquid crystal display panel 2. And as described above, each register of the data register circuit 16 latches the subtractive color image data Dfrc in response to the shift register output signal 34.

The latch circuit 17 latches the subtractive color image data Dfrc of one line received from the data register circuit 16 simultaneously in response to the latch signal 35 received from the timing control circuit 21, then transfers the latched subtractive color image data Dfrc to the data line driving circuit 18.

The data line driving circuit 18 drives the corresponding data line of the liquid crystal display panel 2 in response to the subtractive color image data Dfrc of one line received from the latch circuit 17. More concretely, the data line driving circuit 18 selects a corresponding gradation voltage from among a plurality of gradation voltages supplied from the gradation voltage generation circuit 19 in response to the subtractive color image data Dfrc and drives the corresponding signal line of the liquid crystal display panel 2 to the selected gradation voltage. In this first embodiment, the number of gradation voltages supplied from the gradation voltage generation circuit 19 is 2n.

The gate line driving circuit 20 drives the corresponding gate line of the liquid crystal display panel 2 in response to the gate line control signal 36 received from the timing control circuit 21.

The timing control circuit 21 controls all the timings of the LCD driver 3. Concretely, the timing control circuit 21 generates a horizontal start signal 33, a latch signal 35, and a gate line control signal 36 and supplies those signals to the shift register circuit 15, the latch circuit 17, and the gate line driving circuit 20 respectively.

Next, there will be described the subtractive color processing circuit 12. In the following description, it is premised that "m" is 8 and "n" is 6. In other words, the subtractive color processing circuit 12 generates 6-bit subtractive color image data Dfrc from 8-bit input image data Din. However, "m" and "n" are not limited only to 8 and 6 respectively.

The subtractive color processing circuit 12 includes a weighting circuit 13 and an error diffusion processing circuit 14.

The weighting circuit 13 carries out a "weighting processing" for each input image data Din. The "weighting processing" means a processing that increases or decreases the value of the subtractive color image data Dfrc in accordance with the line that includes the object sub-pixel. In this first embodiment, such a "weighting processing" is carried out for each input image data Din to generate weighted image data Dh and an error diffusion processing is carried out for the weighted image data Dh to generate subtractive color image data Dfrc. Thus a "weighting processing" is carried out to increase or decrease the subtractive color image data Dh, thereby the value of the subtractive color image data Dfrc increases or decreases in accordance with the position of the line to which the object sub-pixel belongs. The detailed content and technical meaning of the "weighting processing" will be described later.

Figure 5B:
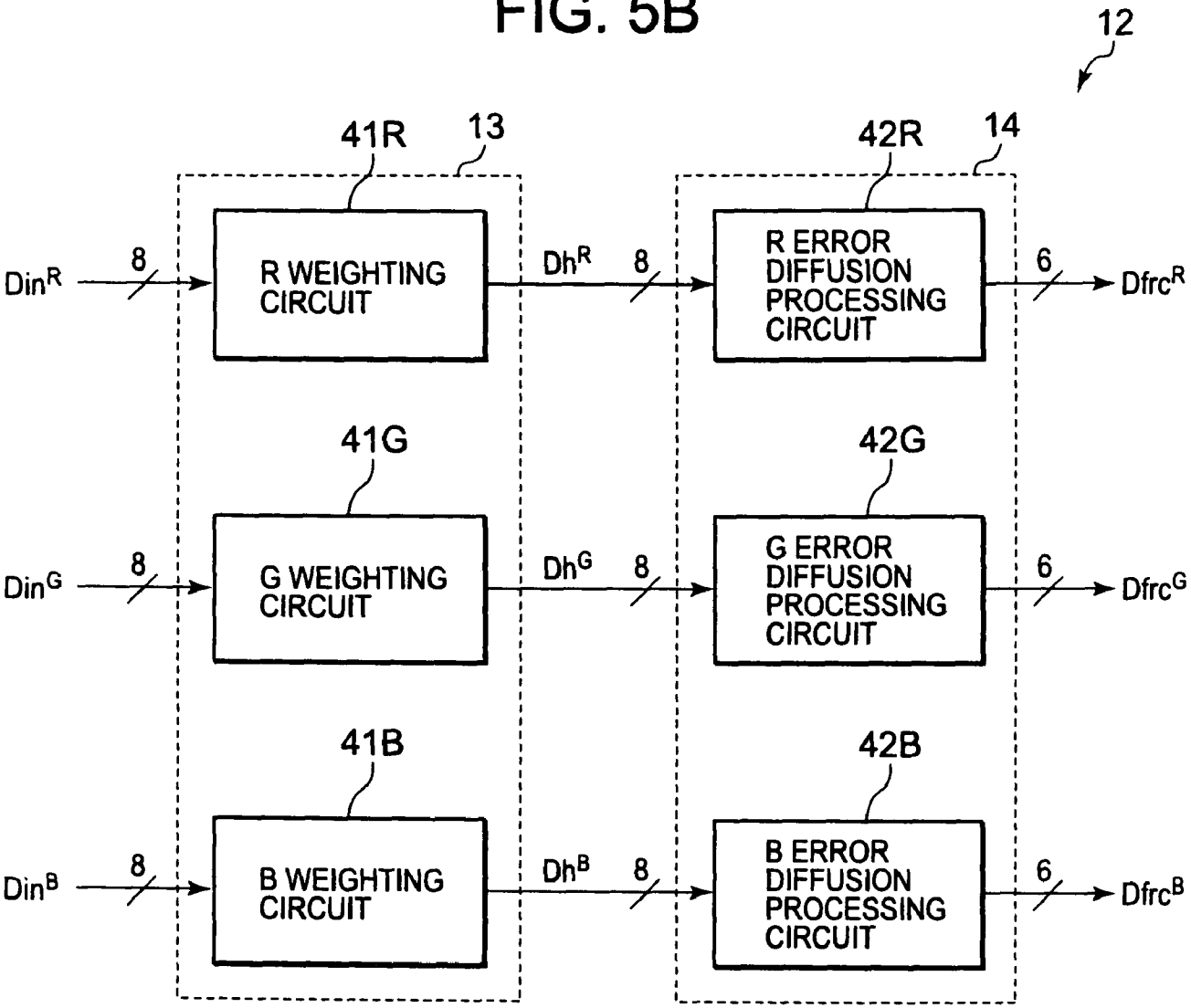
FIG. 5B is a block diagram of a subtractive color processing circuit with respect to its configuration in the first embodiment.

As shown in FIG. 5B, the weighting circuit 13 includes an R weighting circuit 41R corresponding to R sub-pixels, a G weighting circuit 41G corresponding to G sub-pixels, and a B weighting circuit 41B corresponding to B sub-pixels. The weighting circuit 41R carries out a weighting processing for each R sub-pixel input image data DinR to generate weighted image data DhR. Similarly, the weighting circuit 41G carries out a weighting processing for each G sub-pixel input image data DinG to generate weighted image data DhG and the weighting circuit 41B carries out a weighting processing for each B sub-pixel input image data DinB to generate weighted image data DhB.

Figure 6A:
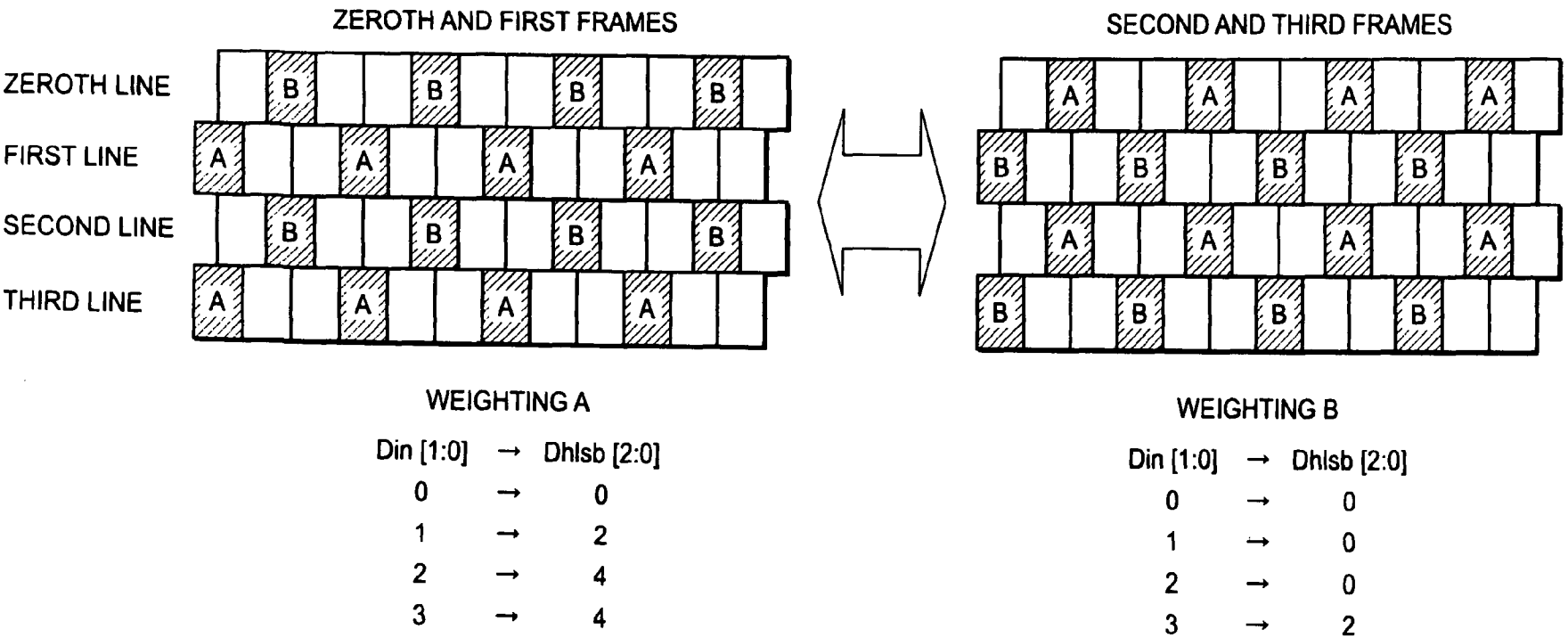
FIG. 6A is a diagram that describes how a weighting circuit carries out a processing carried out in the first embodiment.

FIG. 6A shows a diagram for describing the "weighting processing" carried out by the G weighting circuit 41G in detail.

The G weighting circuit 41G determines 3-bit weighted data Dhlsb [2:0] from the lower-order 2-bit DinG [1:0] of the input image data DinG with respect to each G sub-pixel. The relationship between the lower-order 2-bit DinG [1:0] and the weighted data Dhlsb [2:0] determined by the DinG [1:0] is selected according to the two weighting types "A" and "B" to be described below. If the weighting type "A" is selected, the G weighting circuit 41G determines the weighted data Dhlsb [2:0] as follows (see the illustration at the bottom left in FIG. 6A). If the lower-order 2-bit DinG [1:0] is "0" (=00), the weighted data Dhlsb [2:0] is "0" (=000). If the lower-order 2-bit DinG [1:0] is "1" (=01), the weighted data Dhlsb [2:0] is "2" (=010). If the lower-order 2-bit DinG [1:0] is "2" (=10) or "3" (=11), the weighted data Dhlsb [2:0] is "4" (=100).

On the other hand, if the weighting type "B" is selected, the G weighting circuit 41G determines the weighted data Dhlsb [2:0] as follows (see the illustration at the bottom right in FIG. 6A). If the lower-order 2-bit DinG [1:0] is "0", "1", or "2", the weighted data Dhlsb [2:0] is "0". If the lower-order 2-bit DinG [1:0] is "3", the weighted data Dhlsb [2:0] is "2".

Furthermore, the G weighting circuit 41G calculates the 8-bit weighted image data DhG with use of the following equation.

$$DhG\,[7{:}0]=DinG\,[7{:}2]+Dhlsb\,[2{:}0] \quad (1)$$

Here, DinG [7:2] means data in which the upper-order 6 bits matches with the upper-order 6 bits of the input image data DinG and the lower-order 2 bits are all "0" ("00").

However, if an overflow occurs in the sum between DinG [7:2] and Dhlsb [2:0], an overflow processing is carried out and DhG [7:0] is set to all "1", that is, "255". An overflow occurs only when the input image data DinG is 254 or 255 and the weighting type A is selected.

Whether to select the weighting type "A" or "B" is determined in accordance with the line to which the object sub-pixel belongs. What is important here is that the weighting type is changed between adjacent lines. For example, the weighting type "B" is selected for the G sub-pixels on even-numbered lines in the zeroth frame and the weighting type "A" is selected for the G sub-pixels on odd-numbered lines in the same frame.

Furthermore, the selection of the weighting type "A" or "B" is changed for each prescribed frame. In this first embodiment, the selection of the weighting type "A" or "B" is changed for every other frame (one cycle is assumed to consist of four frames). For example, in the zeroth and first frames, the weighting type "B" is selected for the G sub-pixels on odd-numbered lines and the weighting type "A" is selected for the G sub-pixels on even-numbered lines. On the other hand, in the second and third frames, the weighting type "A" is selected for the G sub-pixels on even-numbered lines and the weighting type "B" is selected for the G sub-pixels on odd-numbered lines. In the subsequent frames, the selection of the weighting type "A" or "B" is changed for every other frame similarly.

Except for the selection of the weighting type "A" or "B" in accordance with each object frame, the R weighting circuit 41R and the B weighting circuit 41B are the same in function as the G weighting circuit 41G. As shown in FIG. 8, in case of the weighting processings by the R weighting circuit 41R and the B weighting circuit 41B, in the zeroth and first frame, the weighting type "A" is selected for the sub-pixels on even-numbered lines and the weighting type "B" is selected for the sub-pixels on odd-numbered lines. On the other hand, in the second and third frames, the weighting type "B" is selected for the sub-pixels on even-numbered lines and the weighting type "A" is selected for the sub-pixels on odd-numbered lines. In the subsequent frames, the selection of the weighting type "A" or "B" is changed for every other frame similarly. Because the selection of the weighting type "A" or "B" differs between R/B sub-pixels and G sub-pixels such way, the luminance of the red, green, and blue sub-pixels can be equalized favorably all over the display screen.

The following three points should be cared with respect to the lower-order 2-bit Dink [1:0] specified for the weighting types "A" and "B".

(a) The weighting type "A" should be selected so that the value of the weighted data Dhlsb [2:0] determined by the weighting type "A" becomes the value of the lower-order 2-bit Dink [1:0] of the input image data Dink and over.

(b) The weighting "B" should be selected so that the value of the weighted data Dhlsb[2:0] determined by the weighting type "B" becomes the value of the lower-order 2-bit Dink [1:0] of the input image data Dink or under.

(c) The weighting types "A" and "B" should be selected so that the average value of the weighted data Dhlsb [2:0] determined by each of the weighting types "A" and "B" matches with a value of the lower-order 2-bit Dink [1:0] of the input image data Dink.

For example, if the lower-order 2-bit Dink [1:0] is "1", the value of the weighted data Dhlsb [2:0] determined by the weighting type "A" is "2" and this value is greater than the value "1" of the lower-order 2-bit Dink [1:0]. If the lower-order 2-bit Dink [1:0] is "1", the value of the weighted data Dhlsb [2:0] determined by the weighting type "B" is "0" and this value is smaller than the value "1" of the lower-order 2-bit Dink [1:0]. If the lower-order 2-bit Dink [1:0] is "1", the values of the weighted data Dhlsb [2:0] determined by each of the weighting types "A" and "B" are "2" and "0" respectively and the average value of those values matches with the value "1" of the lower-order 2-bit Dink [1:0].

FIG. 6B shows a relationship between input image data Dink and weighted image data Dhk generated by a weighting processing. If the weighting type "A" is selected according to the conditions (a) and (b) described above, the weighted image data Dhk is generated so as to become greater than or equal to the input image data Dink. If the weighting type "B" is selected, the weighted image data Dhk is generated so as to become smaller than or equal to the input image data Dink. Furthermore, the weighted image data Dhk is generated so that the average value between the weighted image data Dhk generated by the weighting type "A" carried out for the input image data Dink and the weighted image data Dhk generated by the weighting type "B" carried out for the input image data Dink matches with the input image data Dink as much as possible. Concretely, the weighted image data Dhk is generated so as to satisfy the following equation (2).

$$Dink-1<(DhAk+DhBk)/2<Dink+1, \quad (2)$$

Here, DhAk means the weighted image data generated by the weighting type "A" carried out for the input image data Dink and DhBk means the weighted image data generated by the weighting type "B" carried out for the input imaged at a Dink. The condition of the equation (2) is applied not to reduce the number of actual gradations. The average value (DhAk+DhBk)/2 denotes a gradation to be observed actually and if the average value (DhAk+DhBk)/2 satisfies the above equation (2), a gradation difference can be represented even after the weighting processing. Ideally, the average value (DhAk+DhBk)/2 should preferably match with the input image data Dink. In such a point of view, in this first embodiment, as shown clearly in FIG. 6B, if the value of the input image data Dink is over 0 and under 253, the weighting processing is carried out so that the average value (DhAk+DhBk)/2 matches with the input image data Dink. On the other hand, if the value of the input image data Dink becomes 254 or 255 due to overflow occurrence, the average value (DhAk+DhBk)/2 cannot match with the input image data Dink. In this first embodiment, if the value of the input image data Dink is 254 or 255, the average value (DhAk+DhBk)/2 matches with the value of input image data Dink−0.5.

The error diffusion processing circuit 14 carries out an error diffusion processing for each 8-bit weighted image data Dh generated by the weighting circuit 13 to generate 6-bit subtractive color image data Dfrc. As shown in FIG. 5B, the error diffusion processing circuit 14 includes an R error diffusion processing circuit 42R corresponding to R sub-pixels, a G error diffusion processing circuit 42G corresponding to G sub-pixels, and a B error diffusion processing circuit 42B corresponding to B sub-pixels. The R error diffusion processing circuit 42R carries out an error diffusion processing for each R sub-pixel weighted image data DhR to generate subtractive color image data DfrcR. Similarly, the G error diffusion processing circuit 42G carries out an error diffusion processing for each G sub-pixel weighted image data DhG to generate subtractive color image data DfrcG and the B error diffusion processing circuit 42B carries out an error diffusion processing for each B sub-pixel weighted image data DhB to generate subtractive color image data DfrcB.

Figure 7:
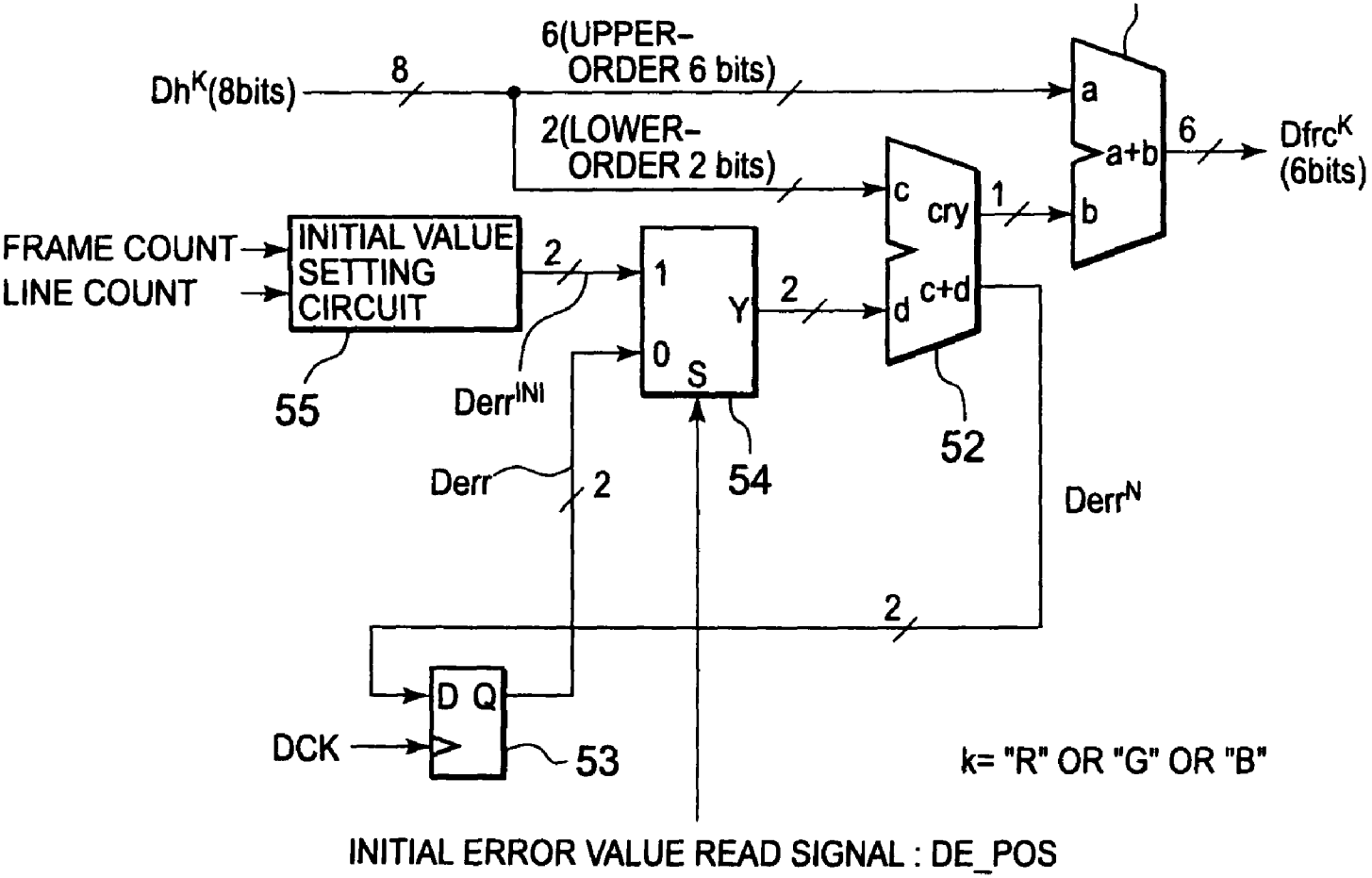
FIG. 7 is a block diagram of an error diffusion processing circuit with respect to its configuration in the first embodiment.

FIG. 7 shows a block diagram for describing the contents of the R error diffusion processing circuit 42R, G error diffusion processing circuit 42G, and B error diffusion processing circuit 42B. Each of the R error diffusion processing circuit 42R, the G error diffusion processing circuit 42G, and the B error diffusion processing circuit 42B generates subtractive color image data Dfrc for one sub-pixel in one clock cycle of the dot clock signal DCL. More concretely, each of the R error diffusion processing circuit 42R, the G error diffusion processing circuit 42G, and the B error diffusion processing circuit 42B includes addition circuits 51 and 52, a D latch 53, a selector 54, and an initial value setting circuit 55. The first input of the addition circuit 51 inputs the upper-order 6 bits of each input image data Dink and the second input thereof inputs a carry output cry of the addition circuit 52. The first input of the addition circuit 52 inputs the lower-order 2 bits of each input image data Dink and the second input thereof is connected to an output of the selector 54. The data output c+d of the addition circuit 52 is connected to the data input of the D latch 53. The output of the D latch 53 is connected to the first input of the selector 54. The second input of the selector 54 is connected to the output of the initial value setting circuit 55. The initial value setting circuit 55 supplies an initial error value DerrINI used in an error diffusion processing. The initial value setting circuit 55 is provided with a frame count denoting the number of an object frame to be subjected to a subtractive color processing and a line account denoting the number of an object line. The initial value setting circuit 55 supplies an initial value DerrINI that differs among frames and lines respectively. The output of the selector 54 is an error value Derr used in the error diffusion processing of an object sub-pixel and the output c+d of the addition circuit 52 is an error value DerrN used in the error diffusion processing of the next sub-pixel.

Each of the R error diffusion processing circuit 42R, the G error diffusion processing circuit 42G, and the B error diffusion processing circuit 42B shown in FIG. 7 operates as follows.

At first, the selector 54 supplies either the initial value DerrINI generated by the initial value setting circuit 55 or the error value Derr held in the D latch 53 to the addition circuit 52 in response to the initial error value DE_POS. Concretely, in the error diffusion processing carried out for the first sub-pixel to be processed on each line, "1" is set for the initial error value DE_POS and the selector 54 supplies the initial value DerrINI to the addition circuit 52 according to the set value "1". On the other hand, in the error diffusion processing carried for another sub-pixel, "0" is set for the initial error value DE_POS and the selector 54 supplies the error value Derr stored in the D latch 53 to the addition circuit 52 according to the set value "0".

The addition circuit 52 adds up the lower-order 2 bits of the input image data Din and the error Derr or initial value DerrINI to calculate a carry output cry and an error value DerrN used in the error diffusion processing for the sub-pixel of which subtractive color image data Dfrc is to be calculated next. The D latch 53, when it is triggered by the dot clock signal DCL, latches the error DerrN output from the addition circuit 52 and updates the error value Derr. The addition circuit 51 then adds up the upper-order 6 bits of the input image data Din and the carry output cry of the addition circuit 52 to generate the subtractive color image data Dfrc for the object sub-pixel.

As a result, each of the R error diffusion processing circuit 42R, the G error diffusion processing circuit 42G, and the B error diffusion processing circuit 42B comes to carry out the following processing.

(1) A Processing for a Sub-Pixel to be Subjected to an Error Diffusion Processing First on Each Line $$Dfrck=(Dhk+DerrINI)>>2,$$

$$DerrN=(Dhk\ [1:0]+DerrINI)\%4$$

Here, the DerrINI means a 2-bit initial value supplied by the initial value setting circuit 55 and the Dhk [1:0] means the lower-order 2 bits of the subject weighted image data Dhk. The ">>2" means a processing for discarding the lower-order 2 bits and the "%4" means a processing for finding a surplus of a division by 4 (this means a processing for discarding the carry if the carry is generated).

(2) A Processing for a Sub-Pixel Other than the First Sub-Pixel to be Subjected to an Error Diffusion Processing $$Dfrck=(Dhk+Derr)>>2,$$

$$DerrN=(Dhk\ [1:0]+Derr)\%4$$

FIG. 8 shows a table for describing the initial values DerrINI generated by the initial value setting circuit 55. In case of a general error diffusion processing, 4 kinds of initial values (0 to 3) are used for 2-bit subtractive color processings. In this first embodiment, however, note that there are only two kinds of initial values (DerrINI: 0 and 2) used for error diffusion processings.

The initial value DerrINI used for the error diffusion processing is changed for each prescribed number of lines and each prescribed number of frames. In this first embodiment, the initial value DerrINI is changed for every other line (one cycle is assumed to consist of four lines) and changed for each frame (one cycle is assumed to consist of two frames). As described above, note that the selection of the weighting type "A" or "B" is changed for each line (one cycle is assumed to consist of two lines) and for every other frame (one cycle is assumed to consist of four frames) in this first embodiment. For example, in case of the error diffusion processing carried out for G sub-pixels in the zeroth frame, the initial value DerrINI of the zeroth and first lines is "0" and that of the second and third lines is "2". Similarly, the initial value DerrINI for the subsequent lines is changed for every other line. On the other hand, the initial value DerrINI is "0" for the G sub-pixels on the zeroth line in the even-numbered frames. In the odd-numbered frames, the initial value DerrINI is "2".

The repeating pattern of the initial value DerrINI in each frame differs among R sub-pixels, G sub-pixels, and B sub-pixels. For the R sub-pixels on the zeroth and first lines, the initial value DerrINI is "2" and for those on the second and third lines, the initial value DerrINI is "0". For the G sub-pixels on the zeroth and first lines, the initial value DerrINI is "0" and for those on the second and third lines, the initial value DerrINI is "2". For the B sub-pixels on the zeroth line, the initial value DerrINI is "2" and for those on the first and second lines, the initial value DerrINI is "0" and for those on the third line, the initial value DerrINI is "2". This pattern is repeated also for the subsequent lines. This is favorable to equalize the luminance in level when taking consideration to the red, green, and blue sub-pixels as a whole.

Figure 9:
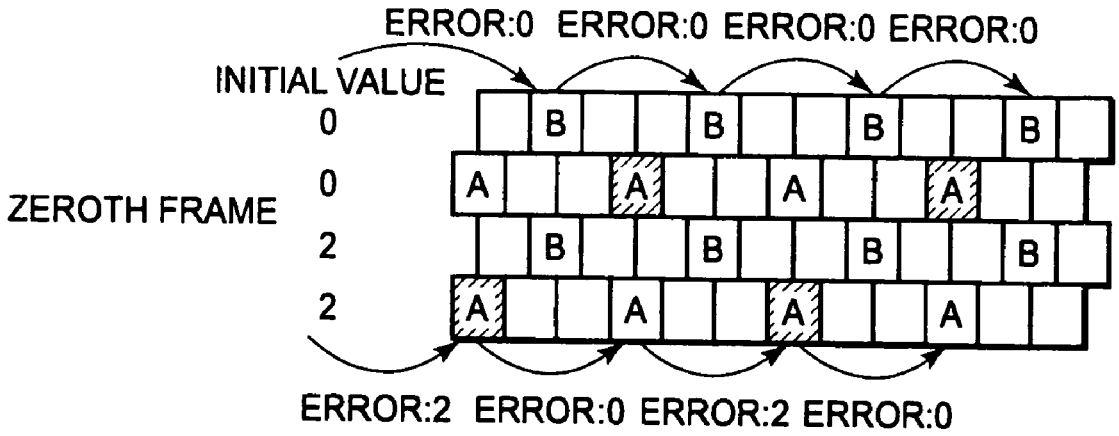
FIG. 9 is a concept diagram that shows an example of the error diffusion processing in the first embodiment.
Figure 9:
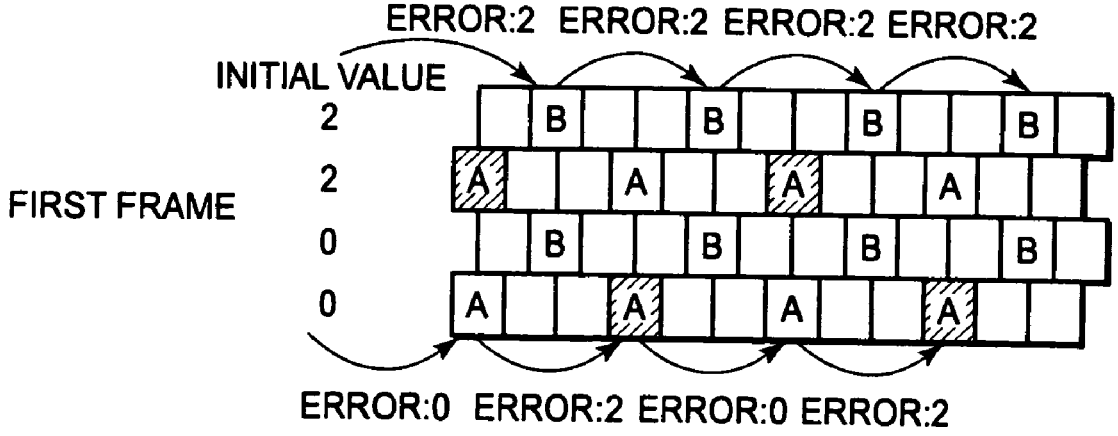

FIG. 9 shows an example of the error diffusion processing carried out for a G sub-pixel when "1" is set for the input image data Dink of every G sub-pixel data. In FIG. 9, each dark hatching portion denotes a G sub-pixel for which "1" is output from the addition circuit 52 as a carry output cry. The initial value DerrINI is "0" for the G pixels on the zeroth line in the zeroth frame. On the other hand, because the weighting type "B" is selected for the zeroth line, the value of the weighted image data Dhk is "0" as to be understood from FIG. 6B. Consequently, the carry output cry from the addition circuit 52 is "0" and the error Derr is "0" for every G sub-pixel on the zeroth line in the zeroth frame.

On the other hand, for the G sub-pixels on the third line in the zeroth frame, the initial value DerrINI is "2". Furthermore, because the weighting type "A" is selected for the third line, the value of the weighted image data Dhk is "2" as to be understood from FIG. 6B. Consequently, in case of the error diffusion processing to be carried out for the left end G sub-pixel, the carry output cry of the addition circuit 52 becomes "1" and the error Derr supplied to the second G sub-pixel is calculated as "0". And in the error diffusion processing to be carried out for the second G sub-pixel, the carry output cry from the addition circuit 52 is "0" and the error Derr supplied to the second G sub-pixel is calculated as "2". In the error diffusion processing to be carried out for the third G sub-pixel, the carry output cry from the addition circuit 52 is "1" and the error Derr supplied to the fourth G sub-pixel is calculated as "0".

The subtractive color image data Dfrck generated such way is sent to the data register circuit 16 and the data lines of the liquid crystal display panel 2 are driven according to the subtractive color image data Dfrck.

By using the subtractive color processing 12 configured such way, the liquid crystal display apparatus 1 in this first embodiment is enabled to suppress the screen flickering to be caused by the unevenness of luminance. This is because the luminance in the horizontal direction is distributed by the error diffusion processing of the error diffusion processing circuit 14 while red, green, and blue sub-pixels are disposed on minutely high luminance lines and minutely low luminance lines alternately due to the weighting processing by the weighting circuit 13. The luminance becomes high minutely for the sub-pixels on each line for which the weighting type "A" is selected in the weighting processing while the luminance becomes low minutely for the sub-pixels on each line for which the weighting type "B" is selected in the weighting processing. As described above, the weighting type is varied between adjacent lines. This is why minutely high luminance lines and minutely low luminance lines are disposed alternately. For example, in the zeroth frame, the luminance of the G sub-pixels on even-numbered lines becomes low minutely while the luminance of the G sub-pixels on odd-numbered lines becomes high minutely. And because the minutely high luminance line and the minutely low luminance line are changed for every prescribed number of frames, the user cannot recognize the difference between high luminance and low luminance.

And because minutely high luminance lines and minutely low luminance lines are disposed alternately as described above, the screen flickering to be caused by the unevenness of luminance is suppressed. This might seem odd technically. According to the knowledge of the present invent or, however, the evenness of the luminance of the red, green, and blue pixels is improved all the better for the unevenness of luminance adopted positively between adjacent lines if the delta arrangement and the error diffusion processing are employed for the subject liquid crystal display panel 2. This is because the same color sub-pixels in the delta arrangement are positioned offset between adjacent lines in the horizontal direction. In the delta arrangement, a specific pixel having a color is positioned most closely to the same color four sub-pixels disposed on adjacent lines and offset in the horizontal direction. Consequently, while minutely high luminance lines and minutely low luminance lines are disposed alternately, it is assured that the luminance of all the four sub-pixels adjacent to a high luminance sub-pixel most closely becomes low. Note that here if only two of the four adjacent sub-pixels positioned most closely is low in luminance, the luminance of all those four sub-pixels becomes uneven. Furthermore, the luminance in the horizontal direction is equalized due to the execution of the error diffusion processing. As a result, the luminance is equalized all over the liquid crystal display panel 2.

Furthermore, the subtractive color processing 12 in this first embodiment employs the error diffusion processing basically, so that the positions of high gradation sub-pixels are changed according to the original image data. This is why the subtractive color processing in this first embodiment is effective to suppress the generation of peculiar patterns that might cause screen flickering.

Next, there will be described the effect of the evenness of luminance improved by both weighting and error diffusion processings.

Figure 10:
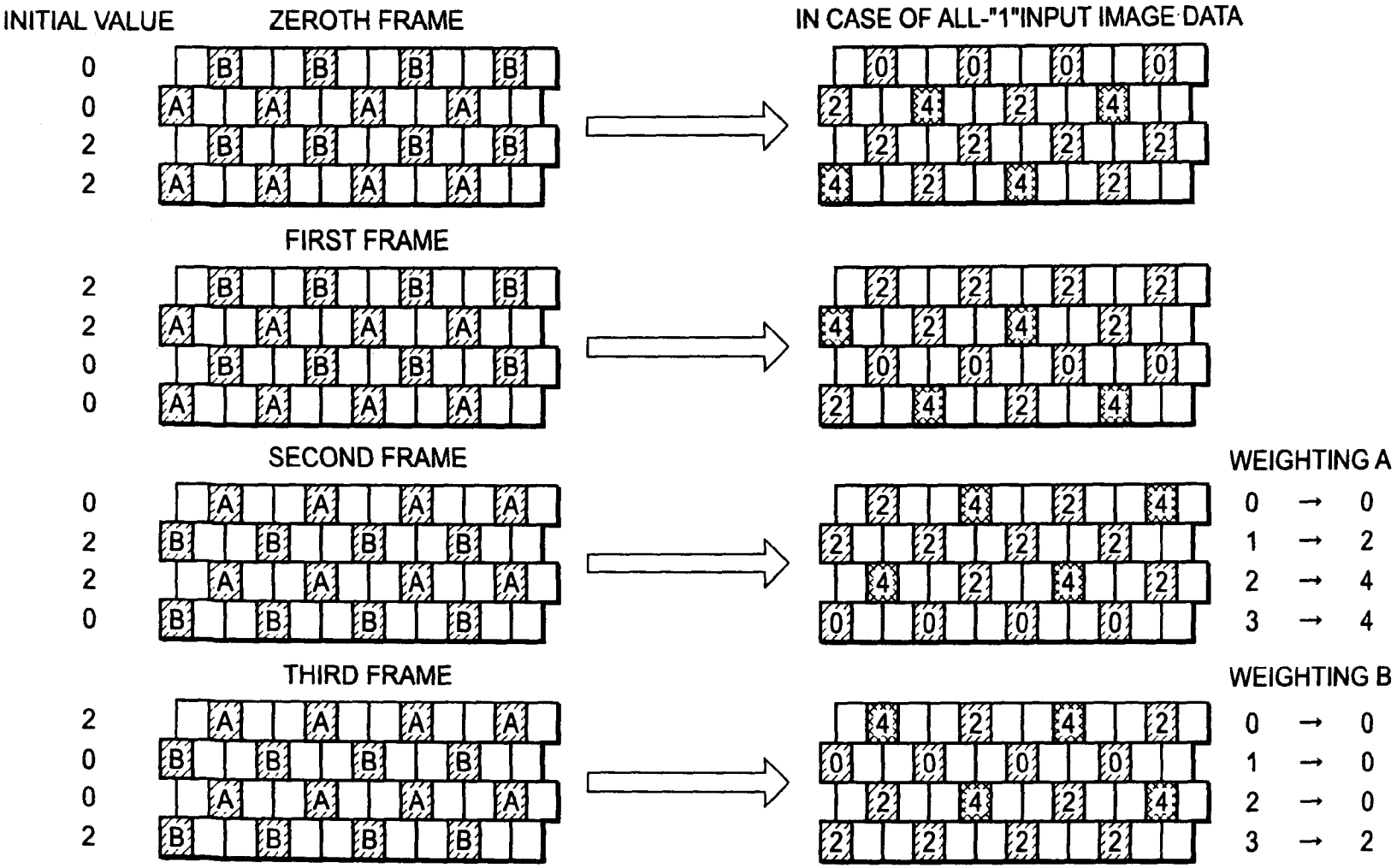
FIG. 10 is a concept diagram for the operation of the subtractive color processing circuit in the first embodiment.

The left illustration in FIG. 10 is for the initial values and the weighting types determined for the zeroth to third lines in a subtractive color processing to be carried out for the G sub-pixels in the zeroth to third frames. For example, in the zeroth frame, the initial value DerrINI determined for the G sub-pixels on the zeroth line is "0" and the weighting type "B" is selected.

The right illustration in FIG. 10 is for the sum of the lower-order 2 bits of the weighted image data DhG calculated for each G sub-pixel and the error Derr when "1" is set for the input image data DinG of every G pixel. For example, in case of the zeroth line in the zeroth frame, "0" is set for the lower two bits of the weighted image data DhG and the initial value is also 0. Consequently, in case of each G pixel on the zeroth line, the sum of the lower-order 2 bits of the weighted image data DhG and the error Derr is 0. In case of the first line in the zeroth frame, 2 is set for the lower-order 2 bits of the weighted image data DhG and the initial value is 0. Consequently, the sum of the lower-order 2 bits of the weighted image data DhG and the error Derr is 2 with respect to the first G sub-pixel to be subjected to the subtractive color processing on the first line. As a result, the carry output cry from the addition circuit 52 becomes 0 and the error DerrN calculated by the error diffusion processing becomes "2". The sum of the lower-order 2 bits of the weighted image data DhG and the error Derr is 4 with respect to the next G sub-pixel to be subjected to the subtractive color processing on the first line. As a result, the carry output cry from the addition circuit 52 becomes "1" and the error DerrN calculated by the error diffusion processing becomes 0. Similarly, it will be understood easily that if "1" is set for the input image data DinG of every G sub-pixel, the sum of the lower-order 2 bits of the weighted image data DhG calculated with respect to each G sub-pixel and the error Derr becomes as shown in the right illustration in FIG. 10.

Figure 11A:
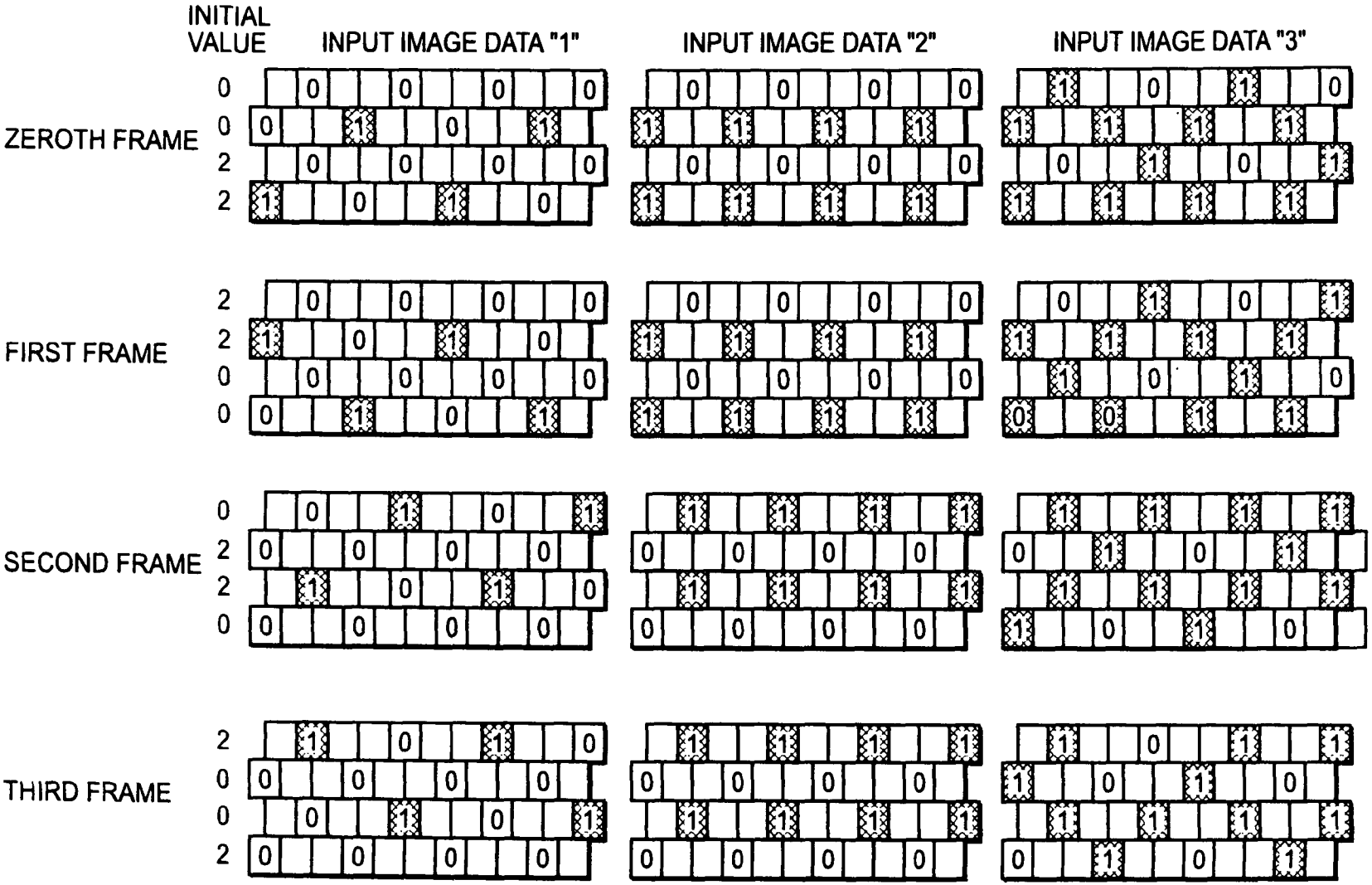
FIG. 11A is a concept diagram for the subtractive color image data generated by the subtractive color processing circuit in the first embodiment.

The left column in FIG. 11A denotes the subtractive color image data DfrcG calculated when 1 is set for the input image data DinG of every G sub-pixel. The carry output cry from the addition circuit 52 becomes "1" and the subtractive color image data DfrcG becomes "1" only when the sum of the lower-order 2 bits of the weighted image data DhG and the error Derr is "4". Note that each G sub-pixel in which subtractive color image data DfrcG is "1" in the leftmost column in FIG. 11A matches with each G sub-pixel having "4" set as the sum of the lower-order 2 bits of the weighted image data DhG and the error Derr in the right column in FIG. 10. As shown in the left column in FIG. 11A, if "1" is set for the input image data DinG of every G sub-pixel, the G sub-pixels having "1" set for the subtractive color image data DfrcG respectively are disposed in a distributed matter. And as shown in the middle and right columns in FIG. 11A, G sub-pixels having "1" set for the subtractive color image data DfrcG respectively are also disposed in a distributed manner similarly if "2" or "3" is set for the input image data DinG of every G sub-pixel.

Figure 11B:
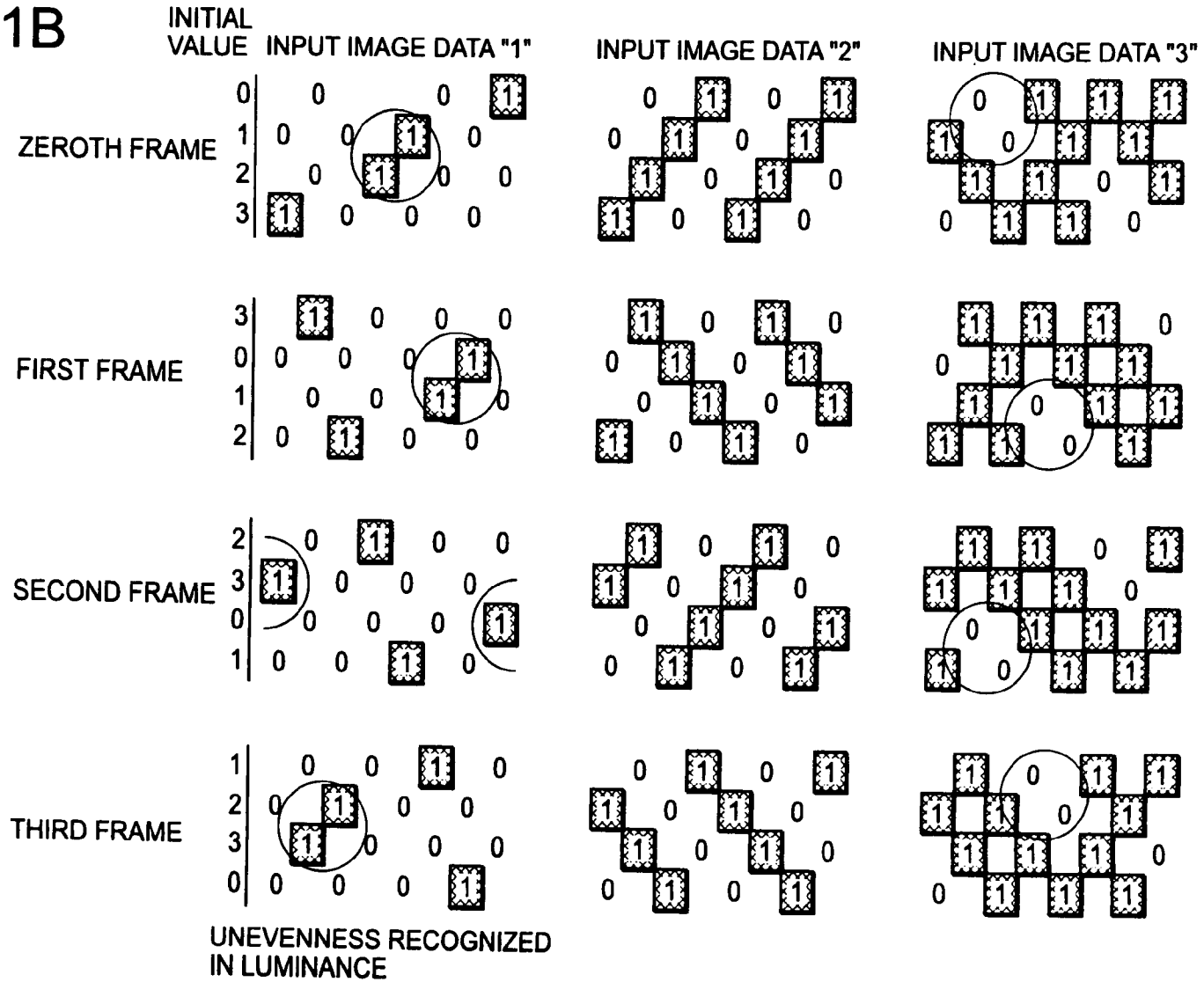
FIG. 11B is a concept diagram for the subtractive color image data generated by a general error diffusion processing.

When compared with the example shown in FIG. 11B, it will be understood more clearly that the subtractive color image data DfrcG generated by the subtractive color processing as described above has an advantage. FIG. 11B shows the subtractive color data generated by a subtractive color processing included in a general error diffusion processing. Concretely, the left column in FIG. 11B denotes the values of the subtractive color image data Dfrc calculated when "1" is set for the input image data DinG of every G sub-pixel. The middle and right columns in FIG. 11B denote the values of the subtractive color image data Dfrc calculated when "2" or "3" is set for the input image data DinG of every G sub-pixel. As to be understood from FIG. 11B, if a subtractive color processing is carried out as part of a general error diffusion processing, the average luminance becomes the same among lines of G sub-pixels. In this case, however, the distribution of luminance becomes uneven all the better for the special characteristics of the delta arrangement. Each circle in FIG. 11B denotes an area in which the luminance of G pixels is uneven. On the other hand, as to be understood from FIG. 11A, in this embodiment, although high luminance G sub-pixels and low luminance G sub-pixels are disposed alternately, the luminance of G sub-pixels is more equalized in this first embodiment. This is because the liquid crystal display panel 2 employs the delta arrangement.

In this first embodiment, how to determine the initial value DerrINI and the weighting type "A"/"B", can be changed in various ways. For example, the weighting type "A"/"B" may be determined in any way other than the above if the following conditions (a) to (c) are satisfied.

(a) The weighting type "A" is selected so that the value of the weighted data Dhlsb [2:0] determined by the weighting type "A" becomes the value of the lower-order 2 bits Dink [1:0] of the subject input image data Dink and over.

(b) The weighting type "B" is selected so that the value of the weighted data Dhlsb [2:0] determined by the weighting type "B" becomes the value of the lower-order 2 bits Dink [1:0] of the subject input image data Dink or under.

(c) The weighting types "A" and "B" are selected so that the average of the values of the weighted data Dhlsb [2:0] determined by the weighting types "A" and "B" respectively matches with a value of the lower-order 2 bits Dink [1:0] of the subject input image data Dink.

FIG. 12A shows a table that denotes the functions of the weighting types "A" and "B" determined by a way other than the above. The difference from the weighting types "A" and "B" shown in FIG. 6A is that the value of the weighted data Dhlsb [2:0] is "2" when "2" is set for the value of the lower-order 2 bits Dink [1:0] of the subject image data Dink in any case of the weighting types "A" and "B". FIG. 12B shows a relationship between the input image data Dink and the weighted image data Dhk generated by a weighting processing when the weighting type "A" shown in FIG. 12A is selected. In case of such a weighting processing, if the input image data Dink of a sub-pixel having a color is "2" and the input image data Dink of a sub-pixel having another color is "0", a high luminance area extended obliquely is generated. In this case, however, the luminance is changed at every other pixel repetitively, so that no screen flickering problem occurs.

Furthermore, in this first embodiment, the subtractive color processing circuit 12 that carries out 2-bit subtractive color processings can also carry out $\alpha$-bit subtractive color processings. In this case, the ($\alpha$+1)-bit weighting data Dhlsb [$\alpha$:0] is determined according to the lower-order $\alpha$-bit Dink [($\alpha$−1):0] of the subject input image data Dink. In this case, the following conditions (a') to (c') corresponding to the above conditions (a) to (c) are set for the weighting types "A" and "B" respectively.

(a') The selection of the weighting type "A" is selected so that the value of the weighted data Dhlsb [$\alpha$:0] determined by the weighting type "A" becomes the value of the lower-order $\alpha$-bit Dink [($\alpha$−1):0] of the subject input image data Dink and over.

(b') The weighting type "B" is selected so that the value of the weighted data Dhlsb [$\alpha$:0] determined by the weighting type "B" becomes the value of the lower-order $\alpha$-bit Dink [($\alpha$−1):0] of the subject input image data Dink or under.

(c') The weighting types "A" and "B" are selected respectively so that the average of the values of the weighted data Dhlsb [$\alpha$:0] determined by the weighting types "A" and "B" matches with a value of the lower-order $\alpha$-bit Dink [($\alpha$−1):0] of the subject input image data Dink.

In case of an $\alpha$-bit subtractive color processing, the initial value of the error diffusion processing is selected from even numbers in a range of 0 to $2^{\alpha}-2$ and the initial value is changed in cycles of $2^{\alpha}$-lines. However, even in an $\alpha$-bit subtractive color processing, the minimum change unit of the initial value is 2 lines. The selection of the weighting type "A" or "B" is made in cycles of 2 lines. Consequently, the same subtractive color processing is never carried out between adjacent lines.

FIG. 13 shows a table denoting examples of the value of the weighted data Dhlsb [3:0] with respect to each of the weighting types "A" and "B" in case of the 3-bit subtractive color processing. FIG. 14 shows a table denoting examples of the selection of the weighting type "A" or "B" and the initial values for each frame and for each line with respect to each of R, G, and B sub-pixels. As shown clearly in the table of FIG. 13, each of the weighting types "A" and "B" satisfies the above conditions (a') to (c'). Furthermore, as shown in FIG. 14, in case of the 3-bit subtractive color processing, one cycle usually consists of 8 lines ($2^3$ lines) and the initial value is changed in cycles of 8 lines ($2^3$ lines). The minimum change unit of the initial value is 2 lines. For example, in case of an error diffusion processing for the G sub-pixels in the zeroth frame, the initial value of the zeroth and first lines is "4" and that of the second and third lines is "6". And the initial value of the fourth and fifth lines is "0" and that of the sixth and seventh lines is "2". This initial value cyclical change pattern is repeated for the subsequent lines.

Figure 15:
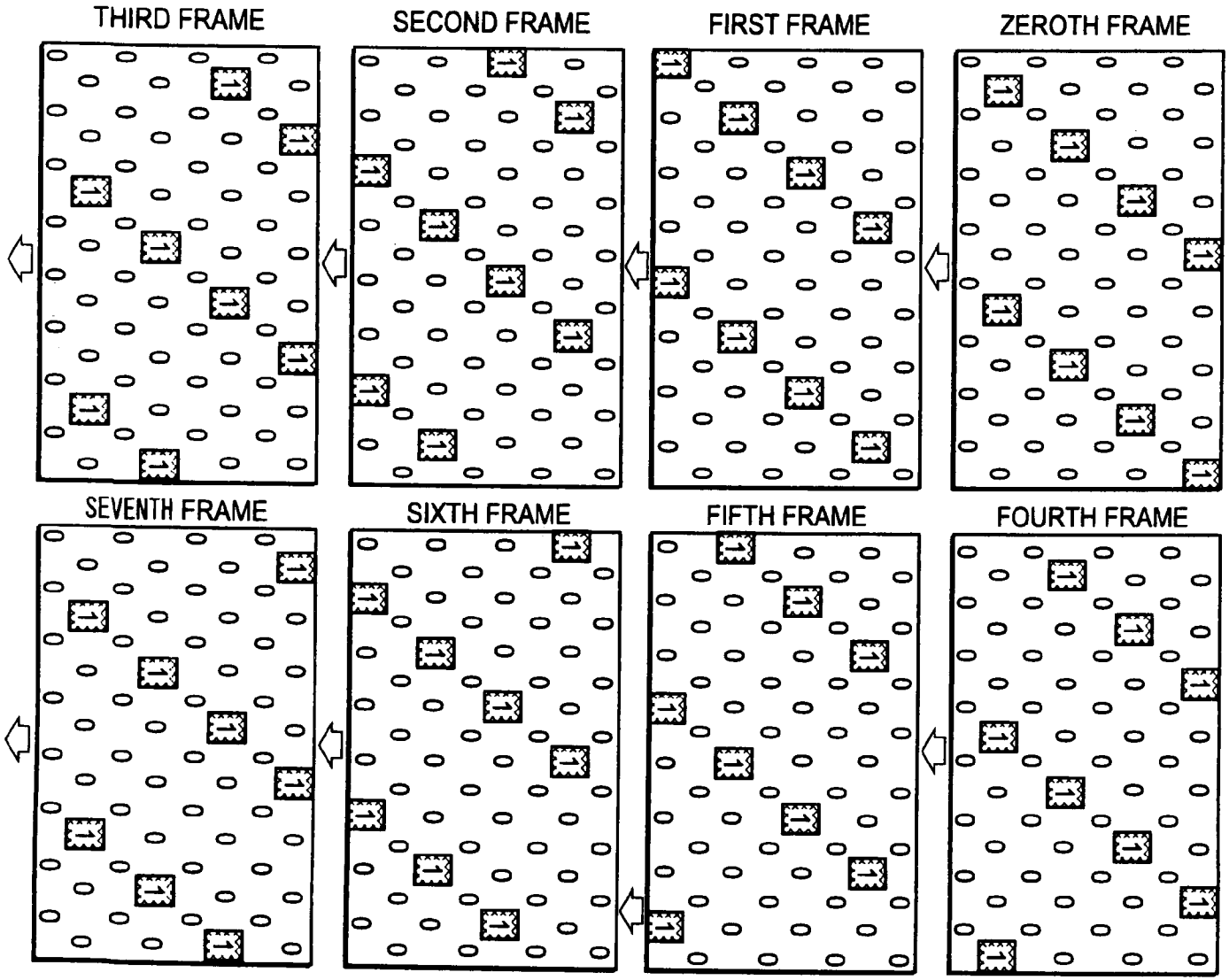
FIG. 15 is a concept diagram that shows the subtractive color image data generated by a 3-bit subtractive color processing carried out in the first embodiment.

FIG. 15 shows examples of the display of the liquid crystal display panel 2 according to the subtractive color image data Dfrc generated by the weighting processing and the error diffusion processing shown in FIGS. 13 and 14. In FIG. 15, the liquid crystal display panel 2 makes a display when the value of the input image data DinG of every G sub-pixel is "1" and the value of the input image data Din of other sub-pixels is "0". Note that here each hatching portion denotes a G sub-pixel that is turned on just like the left column in FIG. 11B. And as shown in FIG. 15, even in case of the 3-bit subtractive color processing, high luminance G sub-pixels are distributed evenly, thereby the screen flickering to be caused by the unevenness of luminance is suppressed effectively.

Furthermore, FIG. 16 shows a table denoting the values of the weighted data Dhlsb [4:0] with respect to each of the weighting types "A" and "B" in case of a 4-bit subtractive color processing. It will be understood easily from this table that the weighting types "A" and "B" shown in FIG. 15 satisfy the above conditions (a') to (c').

(Second Embodiment)

Figure 17A:
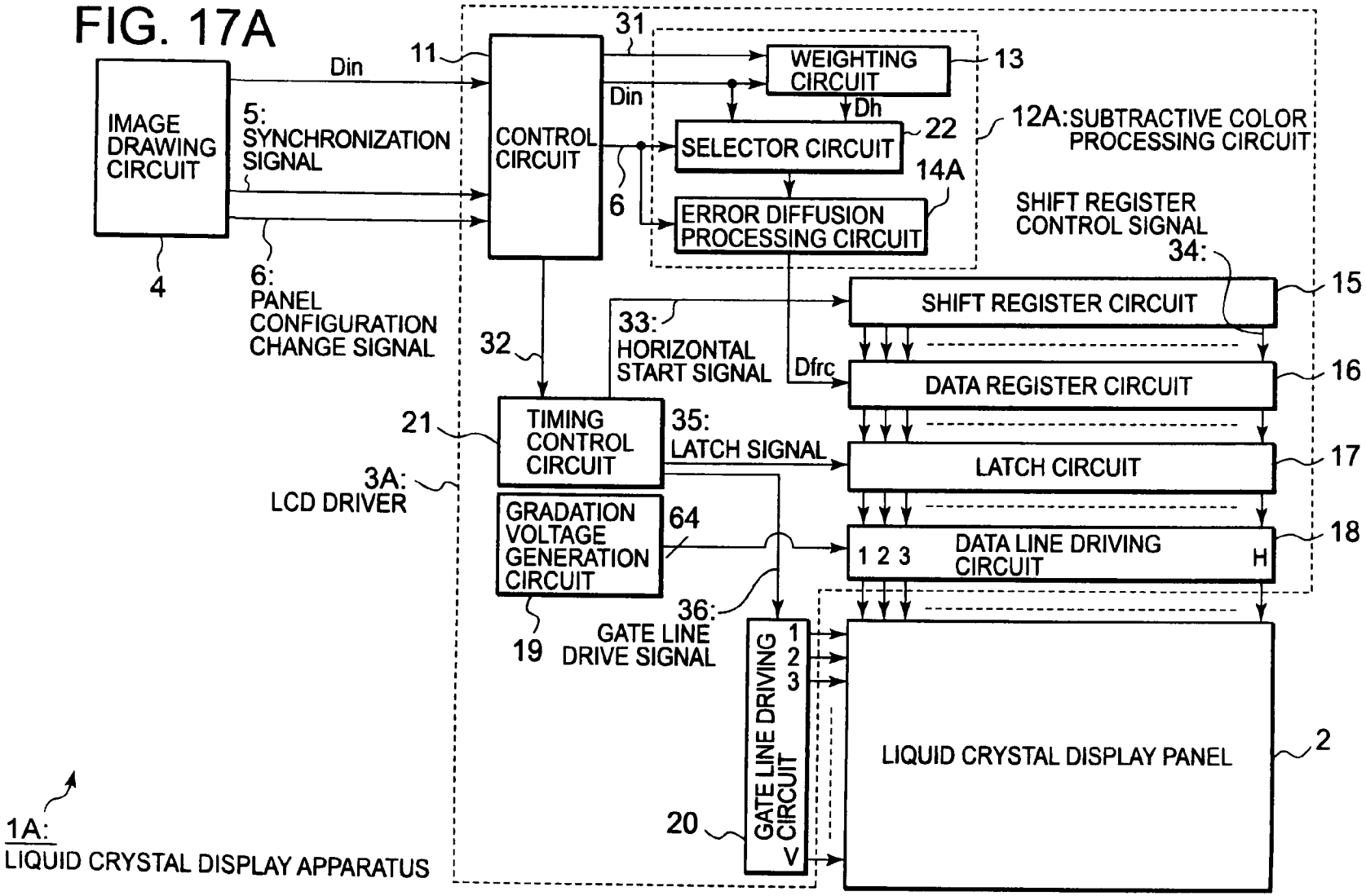
FIG. 17A is a block diagram of a liquid crystal display apparatus with respect to its configuration in a second embodiment.

FIG. 17A shows a configuration of a liquid crystal display apparatus 1A in this second embodiment. In this second embodiment, a subtractive color processing circuit 12A of an LCD driver 3A carries out subtractive color processings that differ between the stripe arrangement and the delta arrangement employed for the liquid crystal display panel 2. The liquid crystal display apparatus 1A configured such way is effective to carry out the subtractive color processings so as to keep the image quality favorably regardless of whether the liquid crystal display panel 2 employs the stripe arrangement or the delta arrangement. As described above, the optimal subtractive color processing differs between the stripe arrangement or the delta arrangement employed for the liquid crystal display panel 2.

More concretely, the LCD driver 3A receives a panel configuration change signal 6 from an image drawing circuit 4. The signal 6 denotes which of the stripe arrangement and the delta arrangement is employed for the liquid crystal display panel 2. A control circuit 11 of the LCD driver 3A supplies the signal 6 to a subtractive color processing circuit 12A. The subtractive color processing circuit 12A includes an error diffusion processing circuit 14A and a selector circuit 22. The selector circuit 22 supplies either the input image data Din supplied from the image drawing circuit 4 or the subtractive color image data Dh supplied from the weighting circuit 13 to the error diffusion processing circuit 14A in response to the signal 6.

Figure 17B:
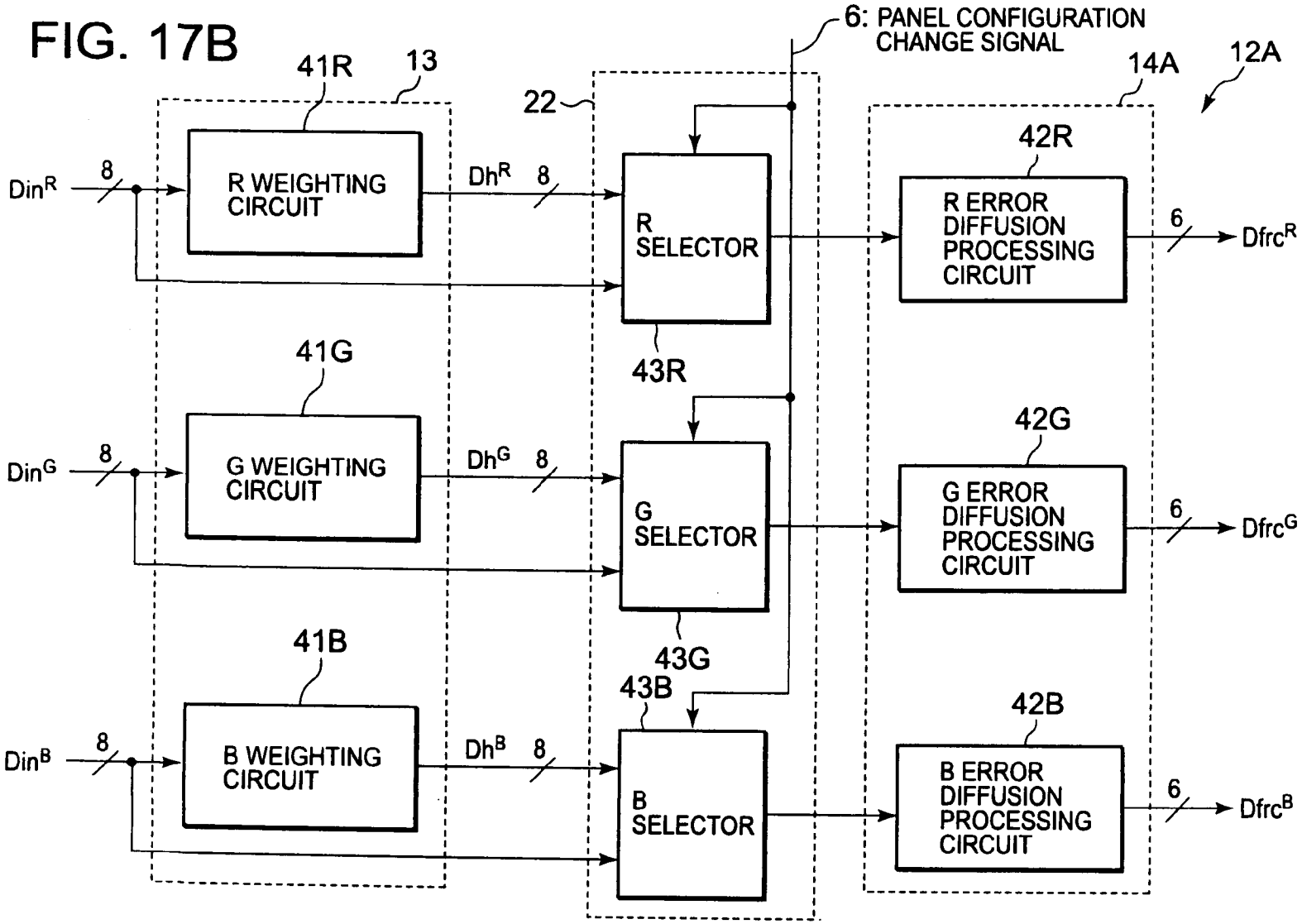
FIG. 17B is a block diagram of a subtractive color processing circuit with respect to its configuration in the second embodiment.

FIG. 17B shows a detailed configuration of the subtractive color processing circuit 12A. The selector circuit 22 is composed of an R selector 43R, a G selector 43G, and a B selector 43B. The R selector 43R supplies either the input image data DinR or the weighted image data DhR generated for an R sub-pixel to the R error diffusion processing circuit 42R in response to the signal 6. More concretely, the R selector 43R, upon receiving the signal 6 that instructs driving of the liquid crystal display panel 2 that employs the delta arrangement, supplies the weighted image data DhR to the R error diffusion processing circuit 42R. On the other hand, upon receiving the signal 6 that instructs driving of the liquid crystal display panel 2 that employs the stripe arrangement, the R selector 43R supplies the input image data DinR to the R error diffusion processing circuit 42R. The R error diffusion processing circuit 42R thus carries out an error diffusion processing for the received input image data DinR or weighted image data DhR. Similarly, the G selector 43G supplies either the input image data DinG or the weighted image data DhG to the G error diffusion processing circuit 42G in response to the signal 6 and the B selector 43B supplies either the input image data DinB or the weighted image data DhB to the B error diffusion processing circuit 42B in response to the signal 6.

Figure 18A:
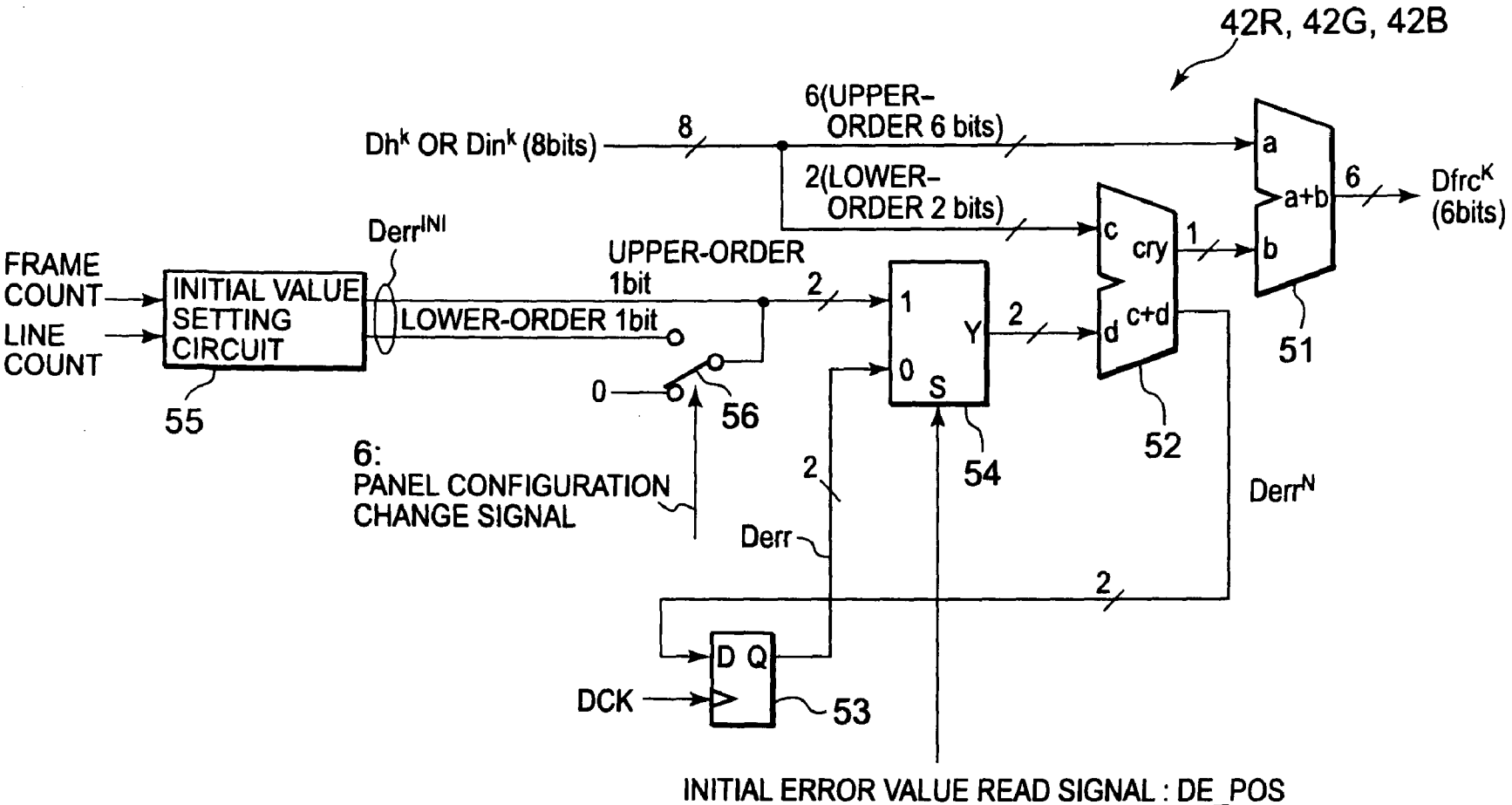
FIG. 18A is a block diagram of an error diffusion processing circuit with respect to its configuration and operations in case of driving the liquid crystal display panel that employs the delta arrangement in the second embodiment.
Figure 18B:
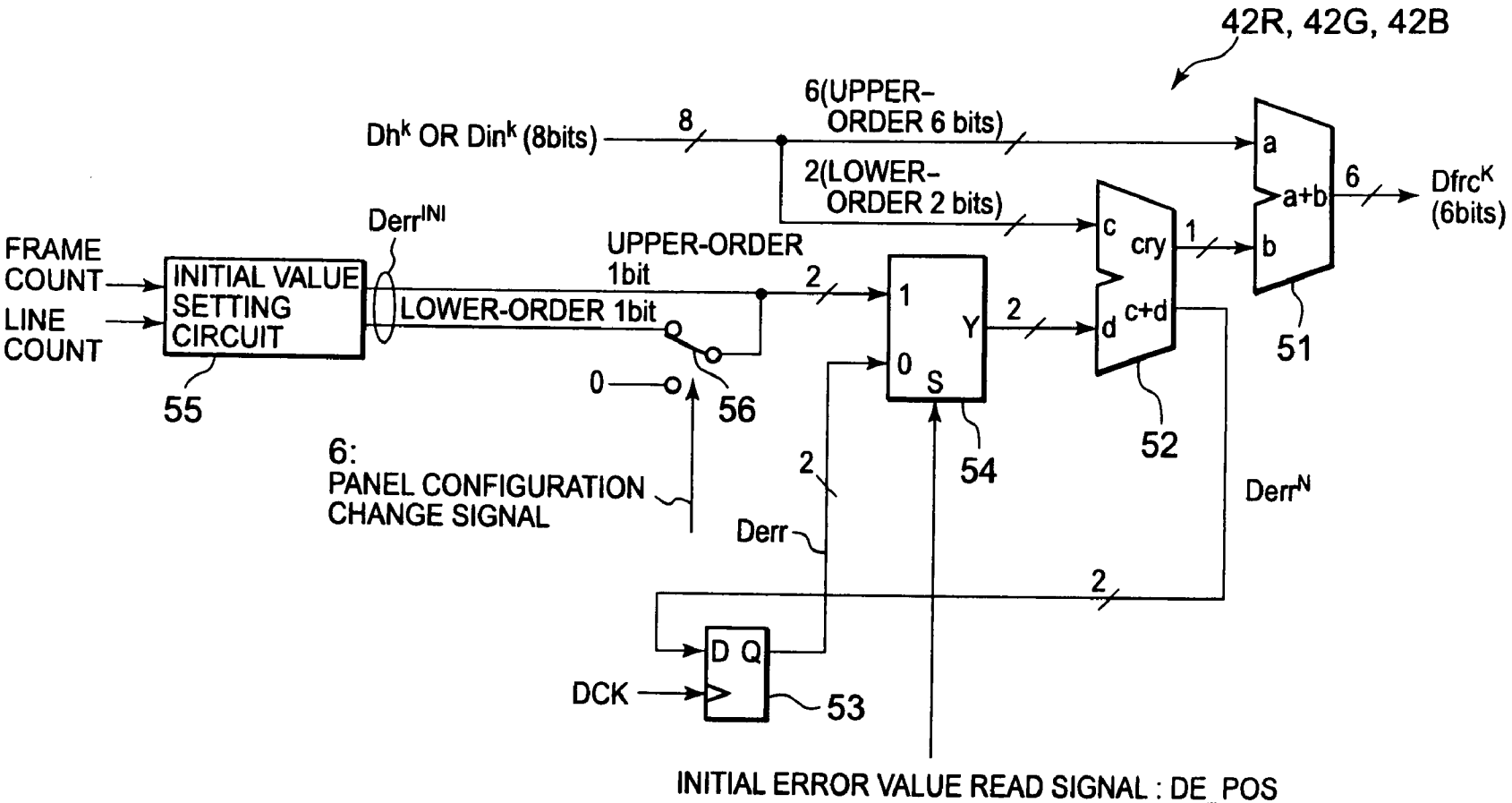
FIG. 18B is a block diagram of the error diffusion processing circuit with respect to its operation in case of driving the liquid crystal display panel that employs the stripe arrangement in the second embodiment.

FIGS. 18A and 18B show circuit diagrams of the error diffusion processing circuit 14A in this second embodiment. The error diffusion processing circuit 14A in this second embodiment differs from the error diffusion processing circuit 14 in the first embodiment shown in FIG. 7 in the following two points.

Firstly, the initial value setting circuit 55, as shown in FIGS. 19A and 19B, outputs four kinds of initial values (0 to 3). The initial value DerrINI generated by the initial value setting circuit 55 is the same as that used in the general error diffusion processing that includes the 2-bit subtractive color processing. The initial value DerrINI output from the initial value setting circuit 55 is changed in cycles of a prescribed number of lines. In this second embodiment, the initial value DerrINI is changed for each line of the four lines consisting of one cycle and changed for each frame of the four frames consisting of one cycle. For example, in case of an error diffusion processing for the zeroth frame with respect to G pixels, the initial values DerrINI of the zeroth to third lines are "0" to "3". Similarly, the initial value DerrINI generated by the initial value setting circuit 55 for the subsequent lines is changed in cycles of 4 lines. However, the repeating pattern of the initial value DerrINI for each frame differs among R sub-pixels, G sub-pixels, and B sub-pixels. This is favorable to equalize the luminance among R, G, and B sub-pixels when taking consideration to the display of the red, green, and blue colors as a whole.

Secondly, the error diffusion processing circuit 14A in this second embodiment includes a switch 56 provided additionally. The switch 56 is used to select either the least significant bit (LSB) of the initial value DerrINI output from the initial value setting circuit 55 or the value "0" as the LSB used in an error diffusion processing carried out actually in response to the signal 6. When the signal 6 instructs driving of the liquid crystal display panel 2 that employs the delta arrangement, the switch 56 selects the value "0" as the LSB of the initial value used actually in the error diffusion processing as shown in FIG. 18A. On the other hand, if the signal 6 instructs driving of the liquid crystal display panel 2 that employs the stripe arrangement, the switch 56 selects the LSB output from the initial value setting circuit 55 as the LSB of the initial value used actually in the error diffusion processing as shown in FIG. 18B.

According to the subtractive color processing circuit 12A configured such way, the subtractive color processing is carried out as described in the first embodiment in response to the panel configuration change signal 6 that instructs the subtractive color processing 12A to drive the liquid crystal display panel 2 that employs the delta arrangement. Concretely, if the signal 6 instructs the subtractive color processing circuit 12A to drive the liquid crystal display panel 2 that employs the delta arrangement, the subtractive color processing circuit 12A operates as follows. At first, the weighting circuit 13 carries out a weighting processing for the input image data Din to generate weighted image data Dh. The selector circuit 22 then supplies the weighted image data Dh to the error diffusion processing circuit 14A. The error diffusion processing circuit 14A then carries out an error diffusion processing for the weighted image data Dh. At this time, the switch 56 of the error diffusion processing circuit 14A selects the value "0" as the LSB of the initial value to be used actually in the subject error diffusion processing. As a result, as shown with each value shown in parentheses in FIG. 19A, the initial value supplied to the addition circuit 52 actually in this second embodiment matches with that shown in FIG. 8. Consequently, if the signal 6 instructs driving of the liquid crystal display panel 2 that employs the delta arrangement, the subtractive color processing circuit 12A carries out the same processing as that described in the first embodiment.

On the other hand, if the signal 6 instructs driving of the liquid crystal display panel 2 that employs the stripe arrangement, the subtractive color processing circuit 12A carries out a general error diffusion processing. Concretely, the subtractive color processing circuit 12A operates as follows. At first, the selector circuit 22 supplies the input image data Din to the error diffusion processing circuit 14A and the error diffusion processing circuit 14A carries out an error diffusion processing for the input image data Din. At this time, the switch 56 of the error diffusion processing circuit 14A selects the LSB of the initial value DerrINI output from the initial value setting circuit 55 as the LSB used actually in the subject error diffusion processing. And as shown in FIG. 19B, the initial value used actually in the error diffusion processing is the same as that used in general error diffusion processing. Consequently, if the signal 6 instructs driving of the liquid crystal display panel 2 that employs the stripe arrangement, the subtractive color processing circuit 12A comes to carry out an ordinary error diffusion processing.

Therefore, according to the LCD driver 3A configured such way in this second embodiment, the LCD driver 3A can carry out the subtractive color processing effectively to keep the image quality favorably regardless of whether the liquid crystal display panel 2 employs the stripe arrangement or delta arrangement.

(Third Embodiment)

Figure 20A:
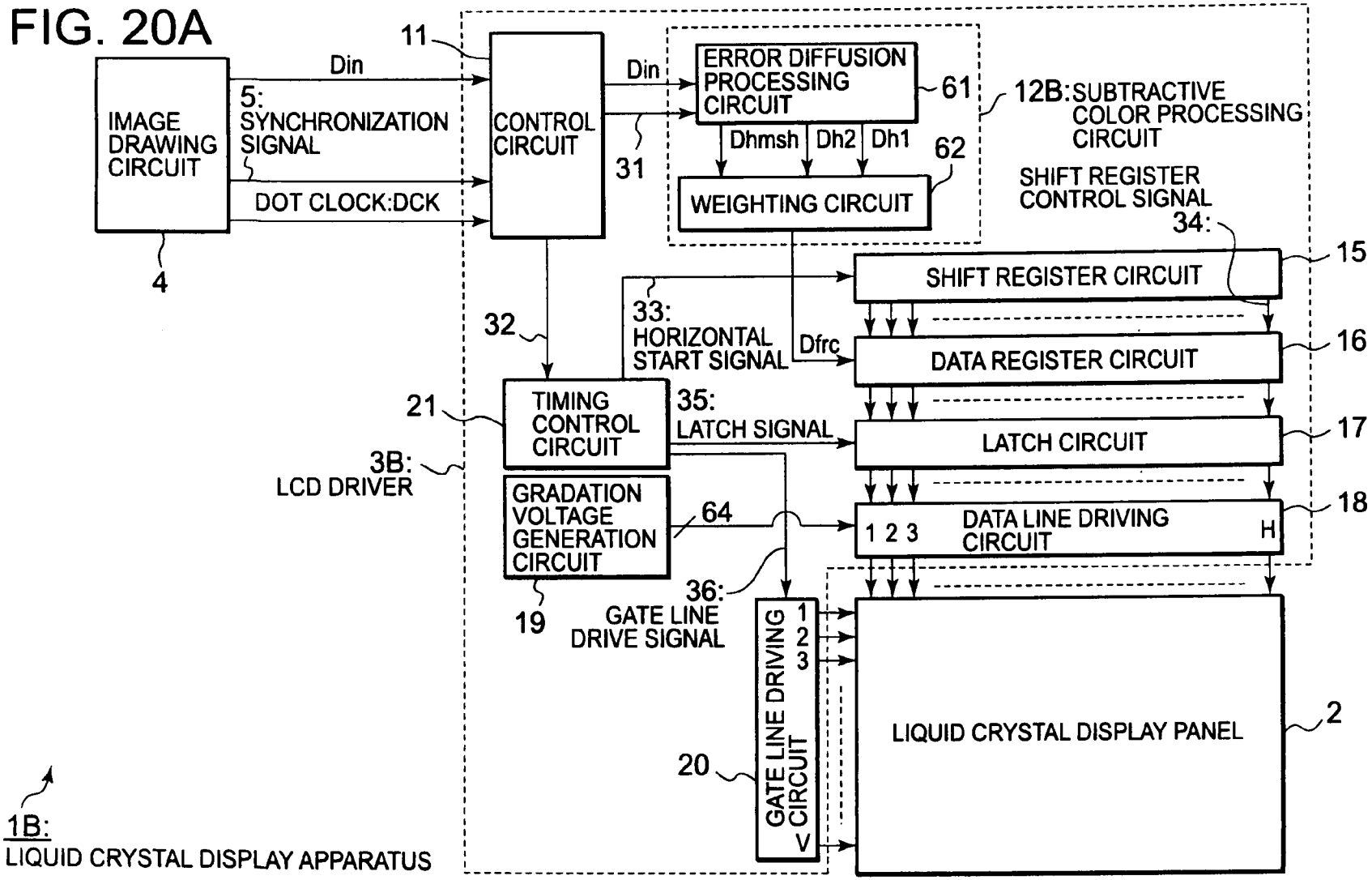
FIG. 20A is a block diagram of a liquid crystal display apparatus with respect to its configuration in a third embodiment.

FIG. 20A shows a block diagram of a liquid crystal display apparatus 1B with respect to its configuration in this third embodiment. This third embodiment differs from the first and second embodiments in that a weighting processing is carried out after an error diffusion processing is carried out. And accordingly, in this third embodiment, the configuration of the subtractive color processing circuit 12B comes to differ from that of the subtractive color processing circuits 12 and 12A in the first and second embodiments.

Figure 20B:
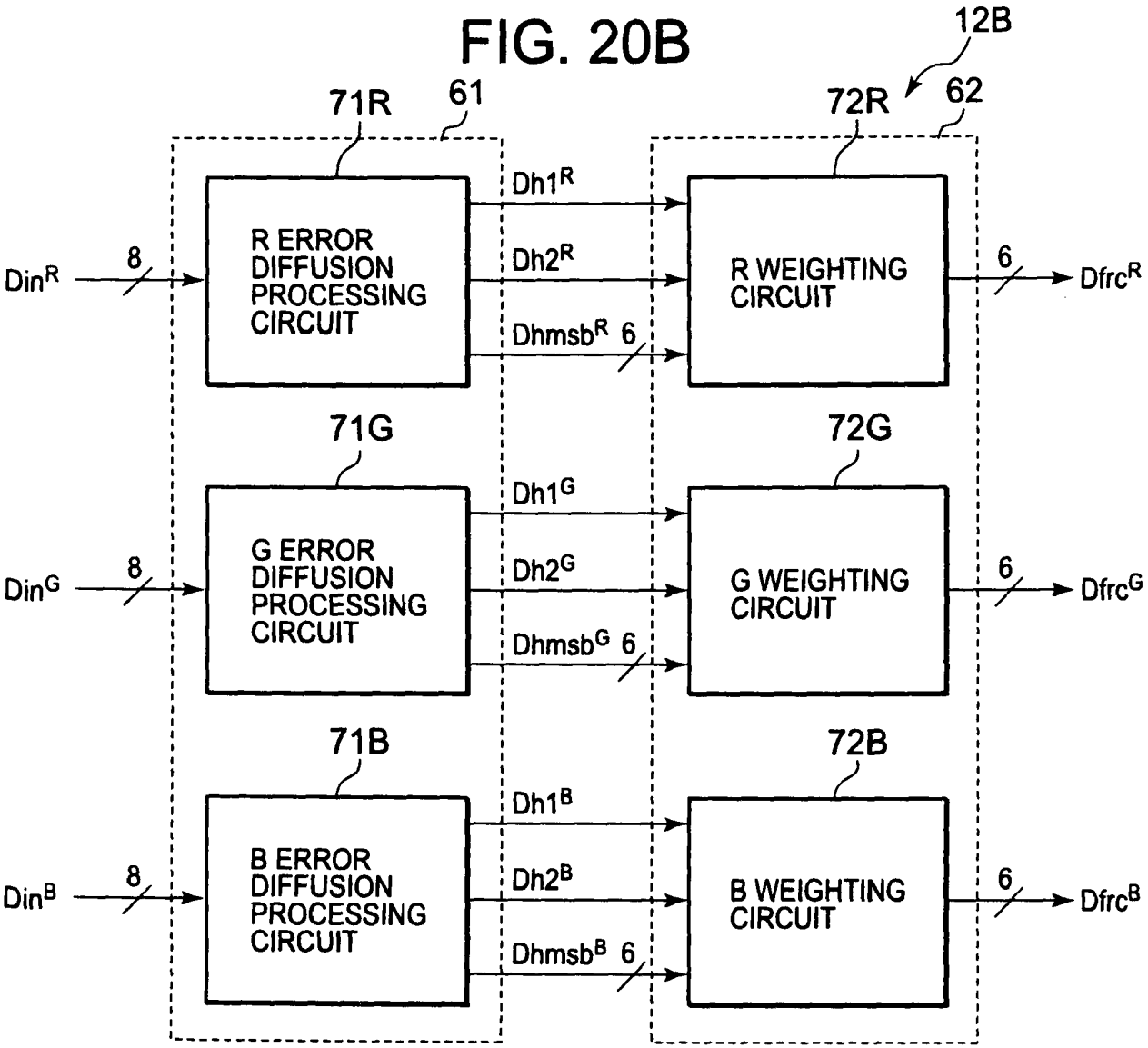
FIG. 20B is a block diagram of a subtractive color processing circuit with respect to its configuration in the third embodiment.

More concretely, the subtractive color processing circuit 12B in this third embodiment includes an error diffusion processing circuit 61 and a weighting circuit 62. As shown in FIG. 20B, the error diffusion processing circuit 61 includes an R error diffusion processing circuit 71R, a G error diffusion processing circuit 71G, and a B error diffusion processing circuit 71B. Note that, however, the configurations and operations of the R error diffusion processing circuit 71R, G error diffusion processing circuit 71G, and B error diffusion processing circuit 71B differ from those in the first and second embodiments.

Figure 21:
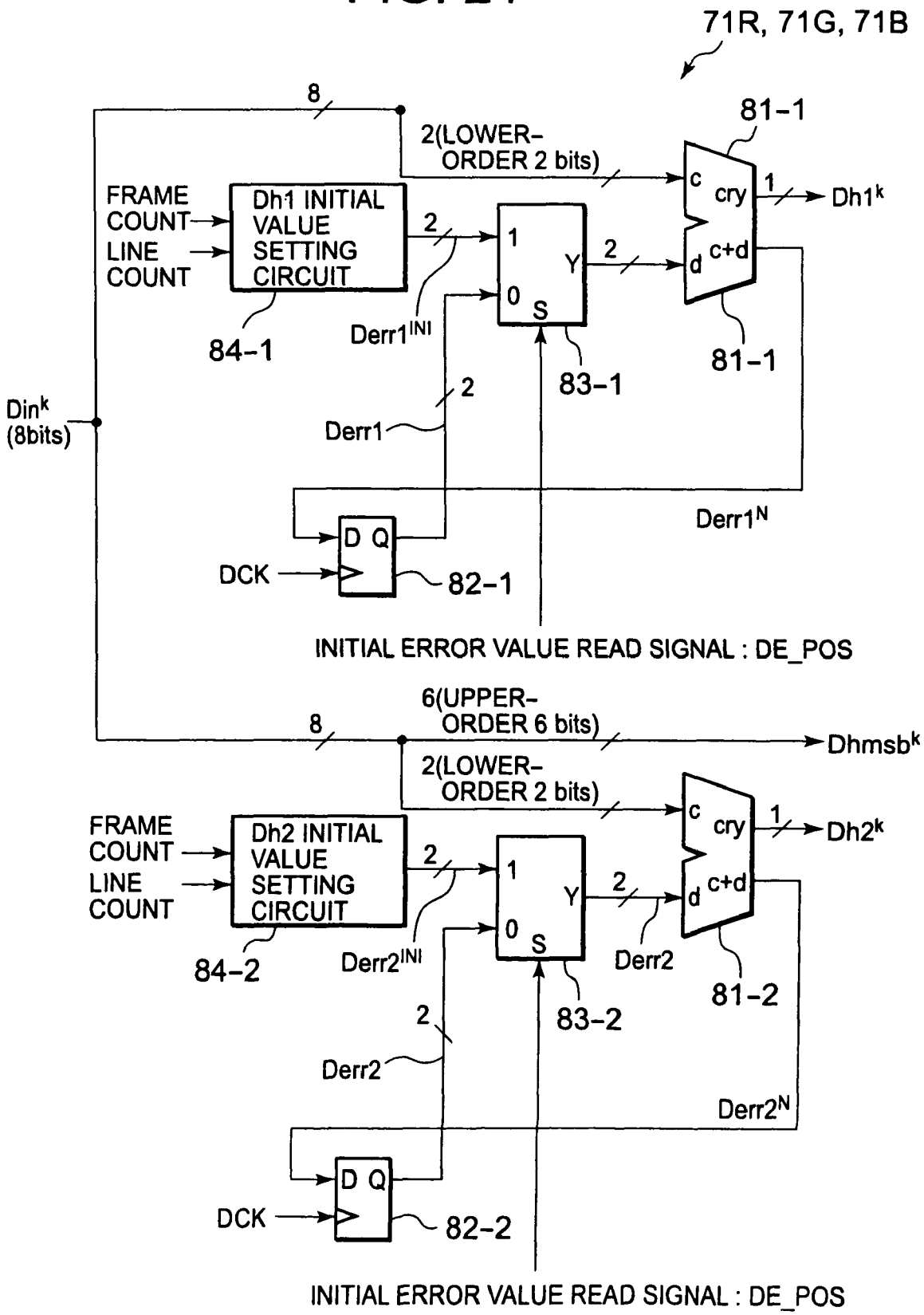
FIG. 21 is a block diagram of an error diffusion processing circuit with respect to its configuration in the third embodiment.

FIG. 21 shows configurations of the R diffusion processing circuit 71R, G error diffusion processing circuit 71G, and B error diffusion processing circuit 71B. Each of the R error diffusion processing circuit 71R, G error diffusion processing circuit 71G, and B error diffusion processing circuit 71B has two processing circuits formed by excluding the addition circuit 51 from the subtractive color processing circuit shown in FIG. 7 and outputs an upper-order bit Dhmsbk and two lower-order bits Dh1*k* and Dh2*k*. The upper-order bit output Dhmsbk is equivalent to the upper-order 6 bits of the input image data Dink and the lower-order bit outputs Dh1*k* and Dh2*k* are equivalent to the carry outputs generated from different initial values.

Concretely, each of the R error diffusion processing circuit 71R, G error diffusion processing circuit 71G, and B error diffusion processing circuit 71B includes addition circuits 81-1 and 81-2, D latches 82-1 and 82-2, selectors 83-1 and 83-2, and a Dh1 initial value setting circuit 84-1, and a Dh2 initial value setting circuit 84-2. And each of the R error diffusion processing circuit 71R, G error diffusion processing circuit 71G, and B error diffusion processing circuit 71B generates an upper-order bit output Dhmsb, as well as lower-order bit outputs Dh1*k* and Dh2*k* corresponding to one sub-pixel respectively in one clock cycle of the dot clock signal DCL.

Each of the Dh1 initial value setting circuit 84-1 and the Dh2 initial value setting circuit 84-2 supplies the initial error value used in the subject error diffusion processing. The initial value generated by each of the Dh1 initial value setting circuit 84-1 and the Dh2 initial value setting circuit 84-2 is usually the same as that used in the error diffusion processing, but each of the Dh1 initial value setting circuit 84-1 and the Dh2 initial value setting circuit 84-2 generates initial values different from those generated by the other. FIG. 22 shows a table denoting the initial values Derr1INI and Derr2INI generated by the Dh1 initial value setting circuit 84-1 and the Dh2 initial value setting circuit 84-2 respectively. The initial value Derr2INI generated by the Dh2 initial value setting circuit 84-2 has a relationship with the initial value Derr1INI generated by the Dh1 initial value setting circuit 84-1 as shown in the following equation.

$$Derr2INI=(Derr1INI+2)\%4$$

The "%4" means a processing that finds a surplus of a division by 4. Furthermore, each of the Dh1 initial value setting circuit 84-1 and the Dh2 initial value setting circuit 84-2 includes a frame count denoting the number of each frame to be subjected to a subtractive color processing and a line count denoting the number of each object line. And each of the Dh1 initial value setting circuit 84-1 and the Dh2 initial value setting circuit 84-2 supplies initial values, each of which differs among frames and among lines.

A combination of the initial values Derr1INI and Derr2INI generated by the Dh1 initial value setting circuit 84-1 and the Dh2 initial value setting circuit 84-2 also differs among the colors of object sub-pixels. For example, in the R error diffusion processing circuit 71R, the combination of the initial values Derr1INI and Derr2INI generated for the zeroth line in the zeroth and first frames is "2" and "0". On the other hand, in the G error diffusion processing circuit 71G, the combination of the initial values Derr1INI and Derr2INI generated for the zeroth line in the zeroth and first frames is "0" and "2". And in the B error diffusion processing circuit 71B, the combination of the initial values Derr1INI and Derr2INI generated for the zeroth line in the zeroth and first frames is "3" and "1".

Each of the R error diffusion processing circuit 71R, the G error diffusion processing circuit 71G, and the B error diffusion processing circuit 71B shown in FIG. 21 operates as follows. Each of the processing circuits 71R, 71G, and 71B extracts the upper-order 6 bits from the input image data Dink and outputs the result as the upper-order bit output Dhmsbk.

Furthermore, each of the R error diffusion processing circuit 71R, the G error diffusion processing circuit 71G, and the B error diffusion processing circuit 71B carries out the following processings to generate lower-order bit outputs Dh1*k* and Dh2*k*.

The lower-order bit output Dh1*k* is generated by a combination of the addition circuit 81-1, the D latch 82-1, the selector 83-1, and the Dh1 initial value setting circuit 84-1. The selector 83-1 supplies either the initial value Derr1INI generated by the Dh1 initial value setting circuit 84-1 or the error Derr1 held in the D latch 82-1 to the addition circuit 81-1 in response to the initial error value read signal DE_POS. Concretely, in case of an error diffusion processing carried out for the first sub-pixel to be subjected to the processing on each line, "1" is set for the initial error value read signal DE_POS. And in response to the set value, the selector 83-1 supplies the initial value Derr1INI to the addition circuit 81-1. On the other hand, in the error diffusion processing for each of other sub-pixels, "0" is set for the initial error value read signal DE_POS and according to the set value, the selector 83-1 supplies the error Derr1 stored in the D latch 82-1 to the addition circuit 52. The addition circuit 81-1 adds up the lower-order 2 bits of the input image data Dink and the error Derr (or the initial value DerrINI) to calculate the lower-order bit output Dh1*k* and the error Derr1N used in the error diffusion processing of the next sub-pixel. The lower-order bit output Dh1 is a carry generated in the addition by the addition circuit 81-1 and the error Derr1N is the sum of the lower-order 2 bits of the input image data Dink and the error Derr (except for the carry). The D latch 82-1, when it is triggered by the dot clock signal DCL, latches the error Derr1N output from the addition circuit 81-1 and update the error Derr1.

On the other hand, the lower-order bit output Dh2*k* is generated by the combination of the addition circuit 81-2, D latch 82-2, selector 83-2, and Dh2 initial value setting circuit 84-2. The operations of the addition circuit 81-2, D latch 82-2, selector 83-2, and Dh2 initial value setting circuit 84-2 are the same as those of the addition circuit 81-1, D latch 82-1, selector 83-1, and Dh2 initial value setting circuit 84-1 described above except that the Derr2INI generated by the Dh2 initial value setting circuit 84-2 differs from the Derr1INI generated by the Dh1 initial value setting circuit 84-1.

The upper-order bit output Dhmsbk and the two lower-order bit outputs Dh1*k* and Dh2*k* generated by the R error diffusion processing circuit 71R, G error diffusion processing circuit 71G, and B error diffusion processing circuit 71B respectively are sent to the weighting circuit 62.

As shown in FIG. 20B, the weighting circuit 62 is composed of an R weighting circuit 72R, a G weighting circuit 72G, and a B weighting circuit 72B. The R weighting circuit 72R generates the subtractive color image data DfrcR from the upper-order bit output DhmsbR and the two lower-order bit outputs Dh1R and Dh2R generated by the R error diffusion processing circuit 71R. Similarly, the G weighting circuit 72G generates the subtractive color image data DfrcG from the upper-order bit output DhmsbG and the two lower-order bit outputs Dh1G and Dh2G generated by the G error diffusion processing circuit 71G and the B weighting circuit 72B generates the subtractive color image data DfrcB from the upper-order bit output DhmsbB and the two lower-order bit outputs Dh1B and Dh2B generated by the B error diffusion processing circuit 71B.

Figure 23:
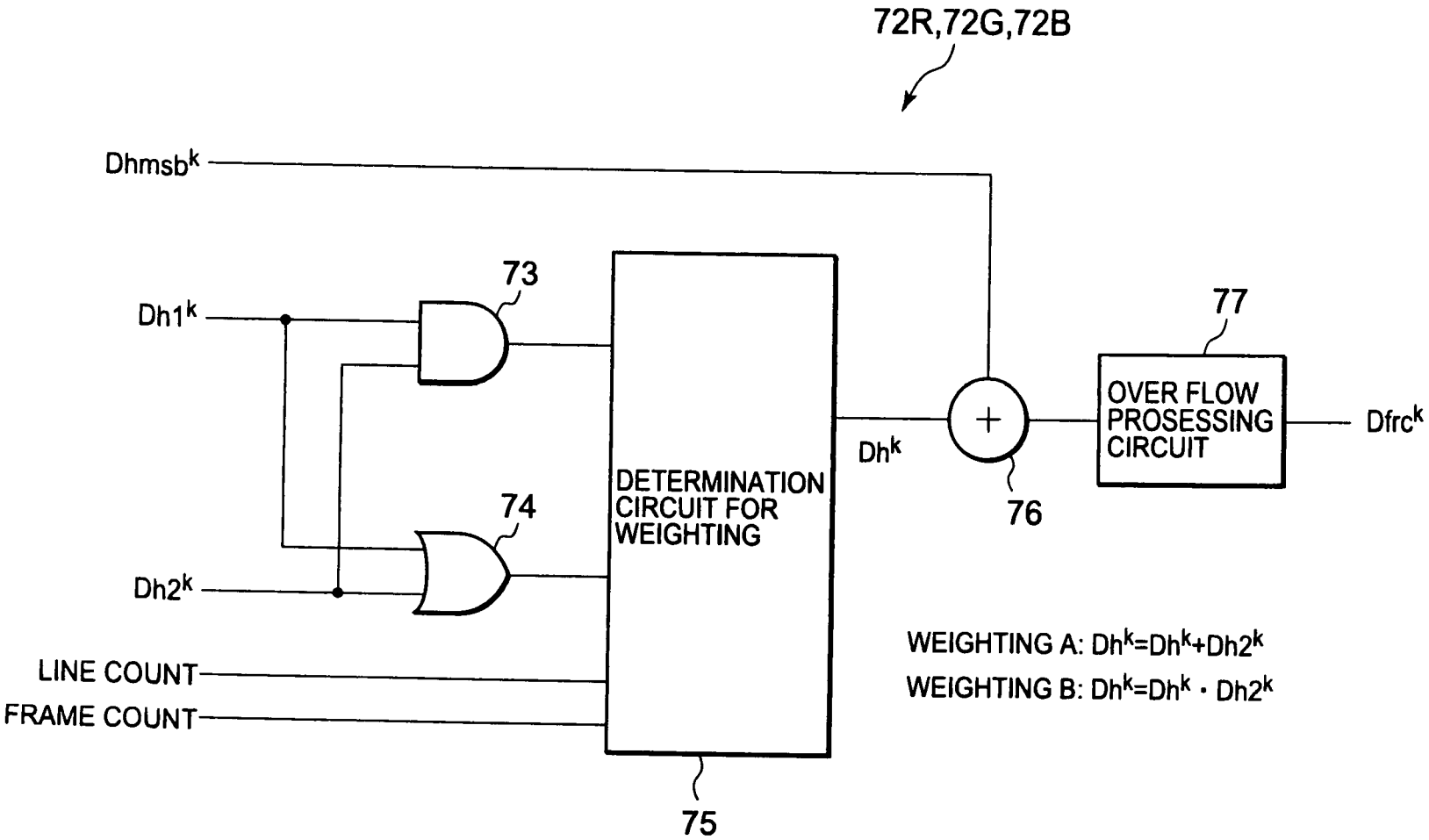
FIG. 23 is a block diagram of a weighting circuit with respect to its configuration in the third embodiment.

FIG. 23 shows a block diagram of the R weighting circuit 72R, G weighting circuit 72G, and B weighting circuit 72B with respect to their configurations. Each of the R weighting circuit 72R, G weighting circuit 72G, and B weighting circuit 72B includes an AND circuit 73, an OR circuit 74, a determination circuit for weighting 75, an addition circuit 76, and an overflow processing circuit 77. The AND circuit 73 outputs a logical product (AND) between lower-order bit outputs Dh1*k* and Dh2*k* and the OR circuit 74 outputs a logical sum (OR) between lower-order bit outputs Dh1*k* and Dh2*k*. The determination circuit for weighting 75 selects either the output of the AND circuit 73 or the output of the OR circuit as a lower-order bit output Dhk according to the frame count denoting the number of an object frame to be subjected to a subtractive color processing and the line count denoting the number of an object line. As to be described later, according to the operation of the determination circuit for weighting 75, the "weighted" subtractive color data Dfrck is generated according to the frame and line counts. The addition circuit 76 adds up the upper-order output Dhmsbk and the lower-order bit output Dhk output from the determination circuit for weighting 75. The overflow processing circuit 77 carries out an overflow processing if an overflow occurs in the addition-up of the upper-order output Dhmsbk and the lower-order bit output Dhk. Concretely, the overflow processing circuit 77 outputs the sum between the upper-order output Dhmsbk and the lower-order bit output Dhk as the subtractive color image data Dfrck if no overflow occurs in the addition-up of the upper-order output Dhmsbk and the lower-order bit output Dhk. On the other hand, if an overflow occurs in the addition-up, the overflow processing circuit 77 sets all "1" for the subtractive color image data Dfrck.

Figure 24A:
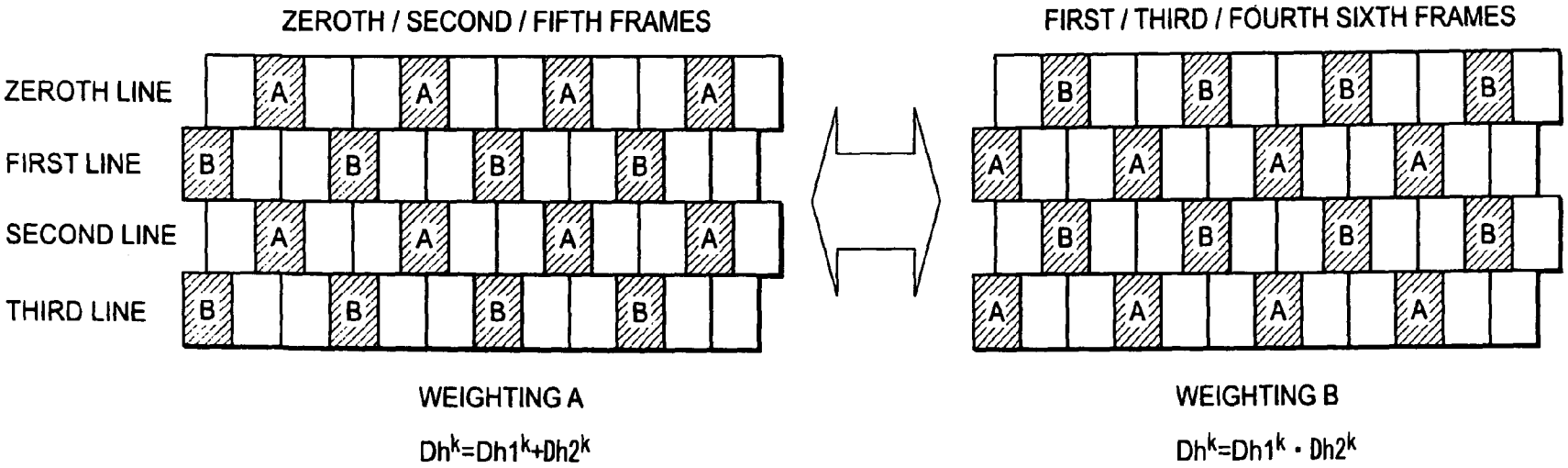
FIG. 24A is a concept diagram that shows the operation of the weighting circuit in the third embodiment.

In this third embodiment, the "weighting processing" is carried out according to the result of the determination by the determination circuit for weighting 75, that is, whether the circuit 75 selects the logical sum or the logical product between the lower-order bit outputs Dh1*k* and Dh2*k* as the lower-order bit output Dhk. As shown in FIG. 24A, in case of the weighting type "A", the logical sum between the lower-order bit outputs Dh1*k* and Dh2*k* is selected as the lower-order bit output Dhk. On the other hand, in case of the weighting type "B", the logical product between the lower-order bit outputs Dh1*k* and Dh2*k* is selected as the lower-order bit output Dhk. Therefore, it is possible to carry out a "weighting processing" that increases or decreases the value of the subtractive color image data Dfrc by selecting either the weighting type "A" or "B". Concretely, if the weighting type "A" is selected (, that is, if the logical sum between the lower-order bit outputs Dh1*k* and Dh2*k* is selected as the lower-order bit output Dhk), the lower-order bit output Dhk becomes "1" when at least one of the lower-order bit outputs Dh1*k* and Dh2*k* is "1". Thus the lower-order bit output Dhk often becomes "1" (when compared with the case in which the weighting type "B" is selected as to be described later). Consequently, the subtractive color image data Dfrc calculated as the sum between the upper-order bit output Dhmsbk and the lower-order bit output Dhk comes often to increase more than the upper-order bit output Dhmsbk. On the other hand, if the weighting type "B" is selected (, that is, if the logical product between the lower-order bit outputs Dh1*k* and Dh2*k* is selected as the lower-order bit output Dhk), the lower-order bit output Dhk becomes "1" only when both the lower-order bit outputs Dh1*k* and Dh2*k* are "1". Thus there are relatively less cases in which the lower-order bit output Dhk becomes "1". As a result, there are less cases in which the subtractive color image data Dfrc increases more than the upper-order bit output Dhmsbk. And accordingly, if the weighting type "A" is selected, the subtractive color image data Dfrc comes to increase relatively and if the weighting type "B" is selected, the subtractive color image data Dfrc comes to decrease relatively.

Whether to select the weighting type "A" or "B" is determined by a line to which the object sub-pixel belongs. What is important here is that the weighting type is changed between adjacent lines. In the example shown in FIG. 24A, for example, in the zeroth frame, the weighting type "A" is selected for the sub-pixels on even-numbered lines and the weighting type "B" is selected for sub-pixels on odd-numbered lines. On the other hand, in the first frame, the weighting type "B" is selected for the sub-pixels on even-numbered lines and the weighting type "A" is selected for the sub-pixels on odd-numbered lines. Similarly, the weighting type is changed between adjacent lines in other frames.

Furthermore, the selection of the weighting type "A"/"B" is changed for each prescribed number of frames. In this third embodiment, the selection of the weighting type "A"/"B" is changed for each frame while one cycle consists of 8 frames. This means that the weighting type "A" is selected for the sub-pixels on even-numbered lines and the weighting type "B" is selected for the sub-pixels on odd-numbered lines in the zeroth, second, fifth, and seventh frames. In the first, third, fourth, and sixth frames, the weighting type "B" is selected for the sub-pixels on even-numbered lines and the weighting type "A" is selected for the sub-pixels on odd-numbered lines.

Because the liquid crystal display apparatus 1 in this third embodiment uses the subtractive color processing circuit 12B configured such way, it is possible to suppress the screen flickering to be caused by the unevenness of luminance. This is because the error diffusion processing carried out by the error diffusion processing circuit 61 disperses the luminance in the horizontal direction and the weighting processing carried out by the weighting circuit 62 enables minutely high luminance sub-pixel lines and minutely low luminance sub-pixel lines to be disposed alternately with respect to the red, green, blue colors respectively. Thus the luminance becomes minutely high for the sub-pixels on the lines for which the weighting type "A" is selected while the luminance becomes minutely low for the sub-pixels on the lines for which the weighting type "B" is selected. And as described above, the weighting type is changed between adjacent lines, so that the minutely high luminance lines and the minutely low luminance lines come to be disposed alternately. In case of the delta arrangement, as it is already described in the first embodiment, if minutely high luminance lines and minutely low luminance lines are disposed alternately, the unevenness of luminance is eliminated more effectively.

Next, there will be described a concrete example of how the evenness of luminance is improved effectively with both the weighting processing and the error diffusion processing. FIG. 24B shows a table denoting the lower-order bits Dh1G and Dh2G calculated with respect to each G sub-pixel on the zeroth line, as well as the lower-order bit DhG obtained from the lower-order bits Dh1G and Dh2G. In the table shown in FIG. 24B, the pixel data DinG of each of the G sub-pixels on the zeroth line has a value sequentially from left to right, "1", "1", "1", "1", "2", "2", "2", "2", "3", "3", "3", and "3".

In the zeroth and first frames, the initial values Derr1INI and Derr2INI of the G sub-pixels on the zeroth line are "0" and "2" respectively. And because the value of the pixel data DinG of each G sub-pixel on the zeroth line is "1", the sum between the initial value Derr1INI and the lower-order 2 bits of the pixel data DinG is "1" and the sum between the initial value Derr2INI and the lower-order 2 bits of the pixel data DinG is "3". Consequently, each of the lower-order bits Dh1G and Dh2G takes a value "0" and the error values of the next sub-pixels Derr1N and Derr2N are "1" and "3" respectively. For the next G sub-pixel on the zeroth line, the sum between the error Derr1INI and the lower-order 2 bits of the pixel data DinG is "2" and the sum between the error Derr1INI and the lower-order 2 bits of the pixel data DinG is "4". Consequently, the value of the lower-order bit Dh1G is "0" and that of the lower-order bit Dh2G is "1". Similarly, for other sub-pixels on the zeroth line and for the sub-pixels in other frames, the values of the lower-order bits Dh1G and Dh2G shown in the upper illustration in FIG. 24B are surely obtained.

The lower-order bit DhG is calculated as a logical sum or product between the lower-order bits Dh1G and Dh2G according to the selection of the weighting type "A"/"B". The lower illustration of FIG. 24B is for a table denoting the lower-order bit DhG calculated from the lower-order bits Dh1G and Dh2G shown in the upper illustration of FIG. 24B. Because the weighting type "A" is selected for the zeroth line in the zeroth frame, the lower-order bit DhG is calculated as the logical sum between the lower-order bits Dh1G and Dh2G. On the first row in the lower illustration of FIG. 24B, the lower-order bit DhG is calculated sequentially as "0", "1", "0", "1", "1", "1", . . . for the G sub-pixels on the zeroth line in the zeroth frame. It would be understood easily that this value matches with the logical sum between the lower-order bits Dh1G and Dh2G of the zeroth frame shown in the upper illustration of FIG. 24B. Furthermore, because the weighting type "B" is selected for the zeroth line in the first frame, the lower-order bit DhG is calculated as the logical product between the lower-order bits Dh1G and Dh2G. On the second row in the lower illustration of FIG. 24B, the lower-order bit DhG is calculated sequentially as "0", "0", "0", "0", "0", "0", . . . for the G sub-pixels on the zeroth line in the first frame. And it would also be understood easily that this value matches with the logical product between the lower-order bits Dh1G and Dh2G of the first frame shown in the upper illustration of FIG. 24B.

Figure 25:
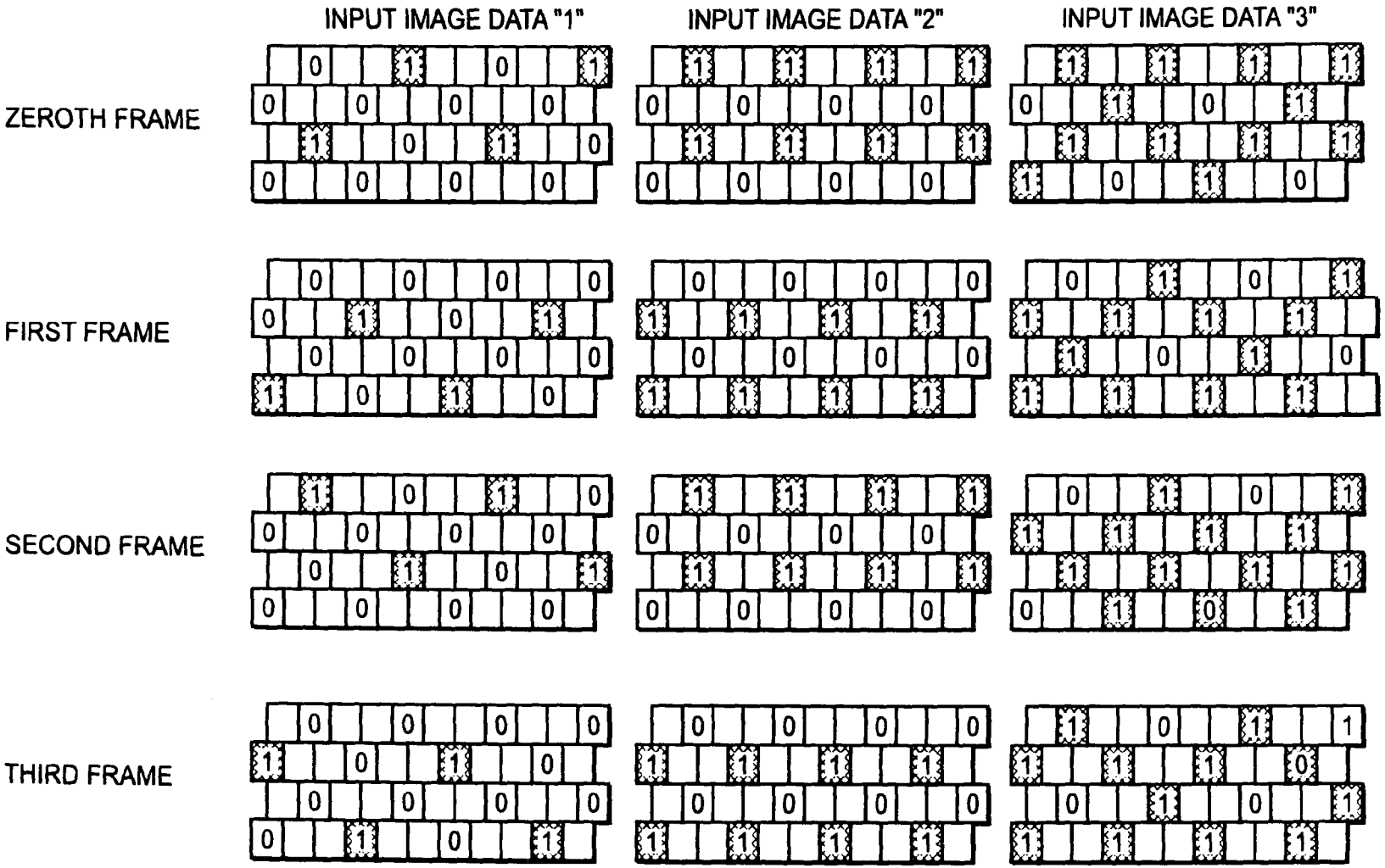
FIG. 25 is a concept diagram that shows subtractive color image data generated by the subtractive color processing circuit in the third embodiment.

The left column in FIG. 25 shows the subtractive color image data DfrcG calculated when the input image data DinG of every G sub-pixel is "1". If the input image data DinG of every G sub-pixel is "1", the subtractive color image data DfrcG becomes "1" only when the lower-order bit DhG is "1". In the left column of FIG. 25, note that each G sub-pixel of which subtractive color image data DfrcG is "1" matches with the G sub-pixel of which lower-order bit DhG is "1" among the first to fourth G sub-pixels in the lower illustration of FIG. 24B. And as shown in the left column of FIG. 25, if the input image data DinG of every G sub-pixel is "1", all the G sub-pixels of which subtractive color image data DfrcG is "1" respectively are disposed in a distributed manner. And similarly, as shown in the middle and right columns of FIG. 25, if the input image data DinG of every G pixel is "2" or "3", all the G sub-pixels of which subtractive color image data DfrcG is "1" respectively are disposed in a distributed manner. Also in this third embodiment, high luminance G pixel lines and low luminance G pixel lines are disposed alternately due to the weighting processings. However, the evenness of luminance is improved all the better for the delta arrangement employed for the liquid crystal display panel 2. That will be understood easily from the example shown in FIG. 25.

(Fourth Embodiment)

Figure 26:
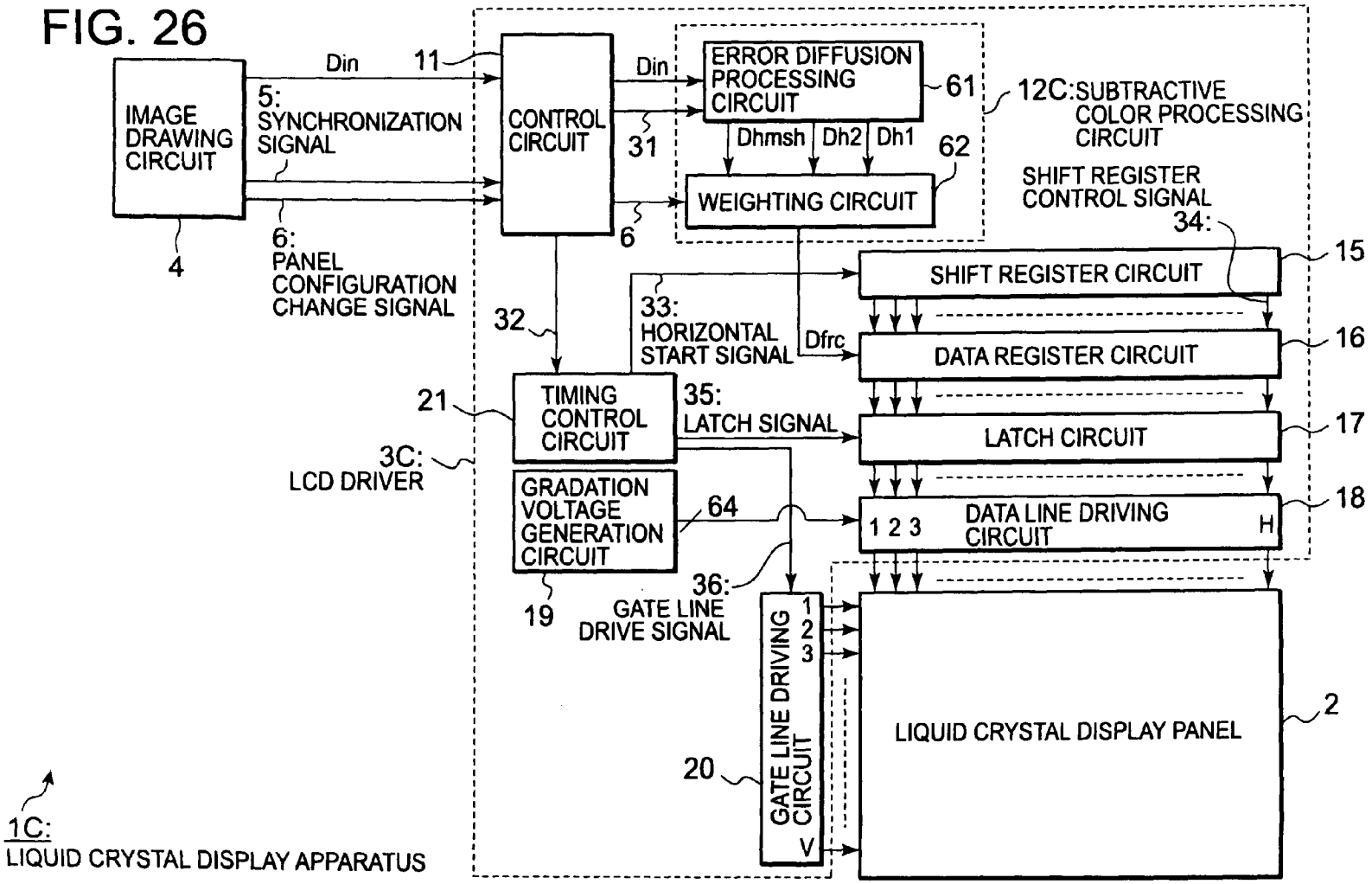
FIG. 26 is a block diagram of an error diffusion processing circuit with respect to its configuration in a fourth embodiment.

FIG. 26 shows a configuration of a liquid crystal display apparatus 1C in this fourth embodiment. In this fourth embodiment, a subtractive color processing circuit 12C of an LCD driver 3C carries out the subtractive color processing determined according to whether the stripe arrangement or delta arrangement is employed for the liquid crystal display panel 2. Such a configuration is effective to carry out the subtractive color processing preferred to keep the image quality favorably regardless of whether the liquid crystal display panel 2 employs the stripe arrangement or delta arrangement.

More concretely, the LCD driver 3C receives the panel configuration change signal 6 from the image drawing circuit 4. The signal 6 denotes which of the stripe arrangement and the delta arrangement is employed for the liquid crystal display panel 2. A control circuit 11 of the LCD driver 3C supplies the signal 6 to the weighting circuit 62 of the subtractive color processing circuit 12C.

Figure 27A:
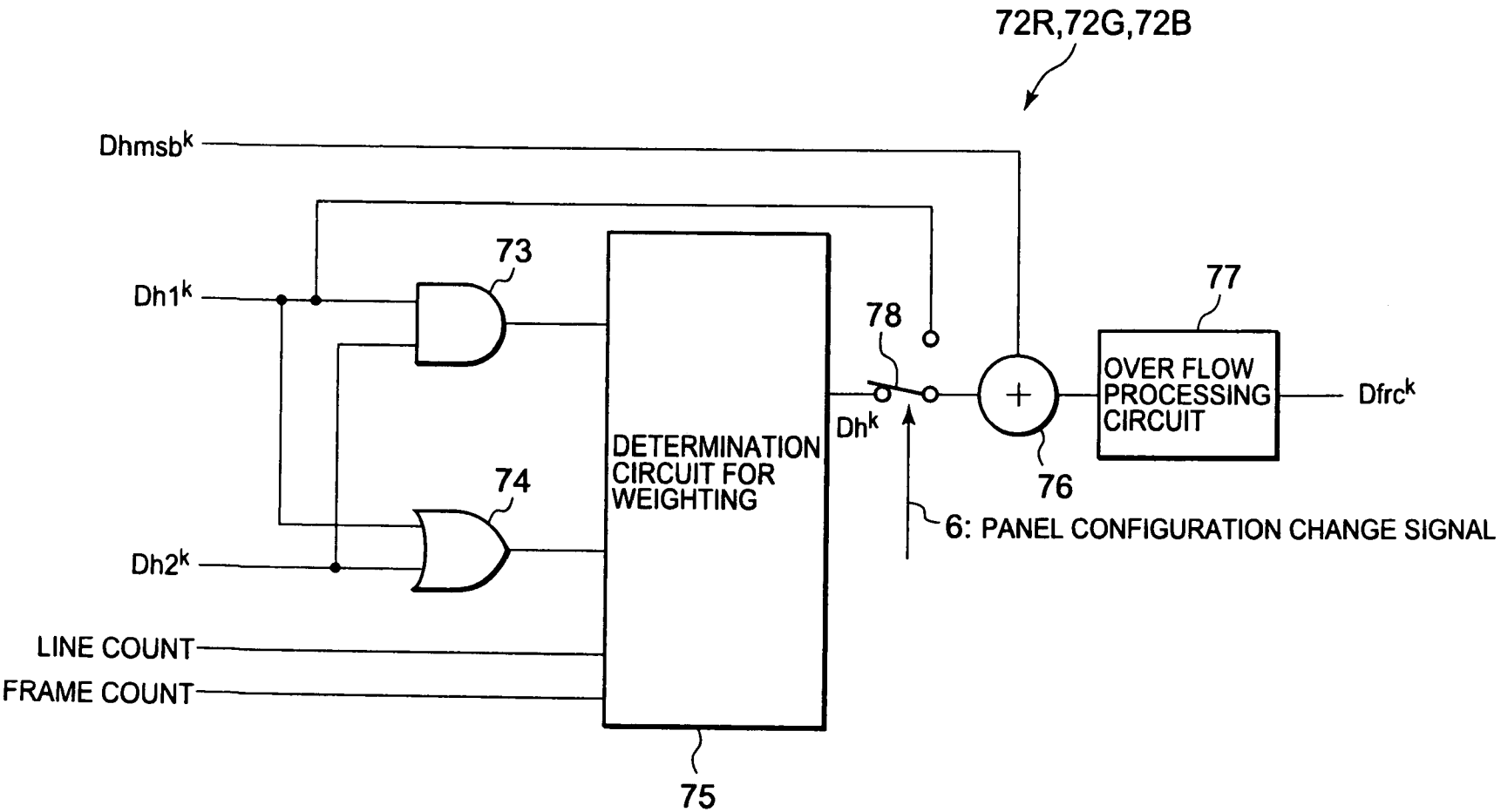
FIG. 27A is a block diagram of a weighting circuit with respect to its configuration and operations in case of driving the liquid crystal display panel that employs the delta arrangement in the fourth embodiment.
Figure 27B:
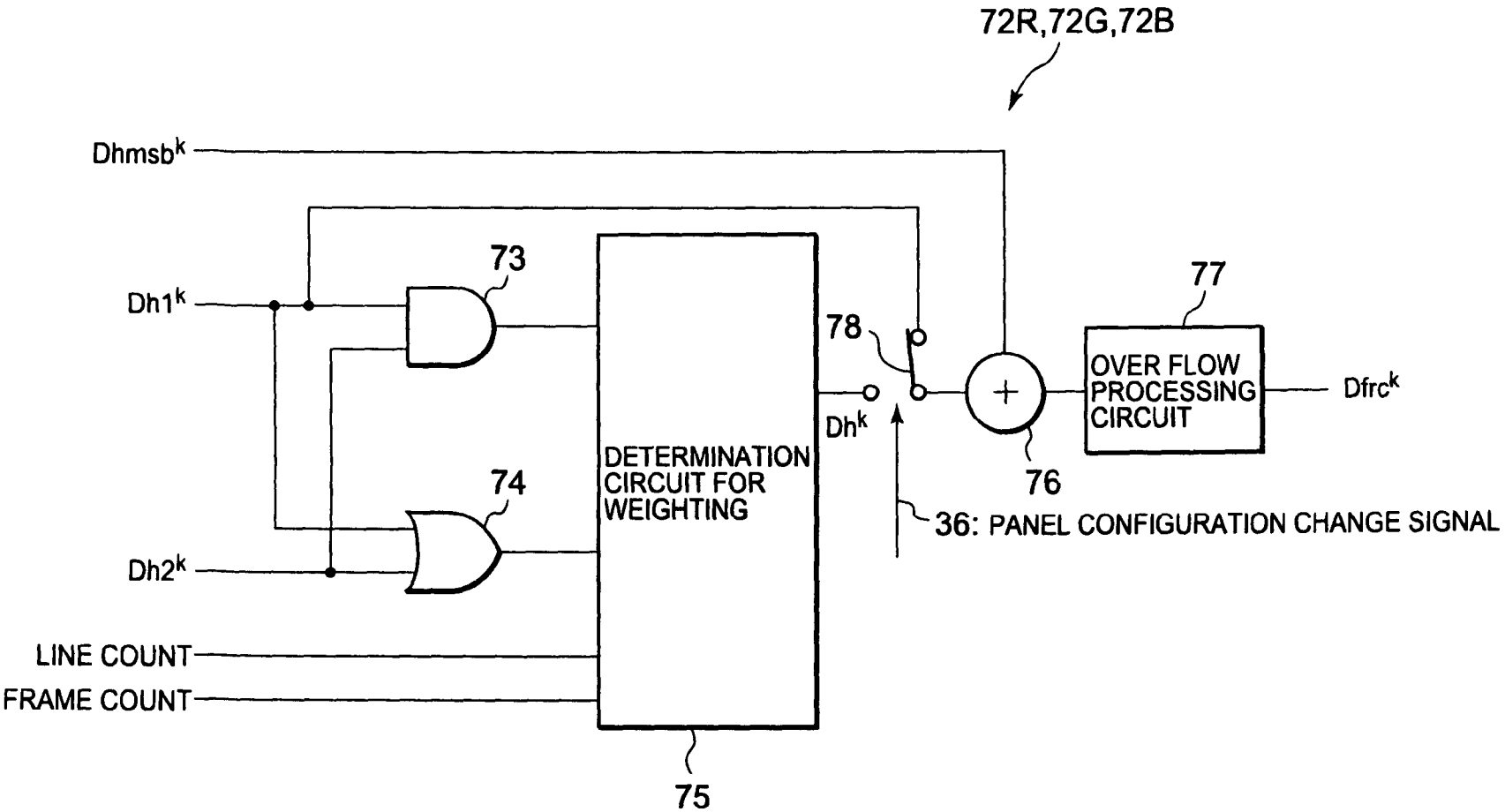
FIG. 27B is a block diagram of a weighting circuit with its respect to its operation in case of driving a liquid crystal display panel that employs the stripe arrangement in the fourth embodiment.

As shown in FIGS. 27A and 27B, in this fourth embodiment, the configurations of the R weighting circuit 72R, G weighting circuit 72G, and B weighting circuit 72B included in the weighting circuit 62 are changed. Furthermore, in this fourth embodiment, a switch 78 is added to each of the R weighting circuit 72R, G weighting circuit 72G, and B weighting circuit 72B. The switch 78 outputs either the value of the lower-order bit Dh1*k* supplied from the error diffusion processing circuit 61 or the value of the lower-order bit Dhk output from the determination circuit for weighting 75 to an addition circuit 76 in response to the signal 6.

According to the subtractive color processing circuit 12C configured such way, if the panel configuration change signal 6 instructs the driving of the liquid crystal display panel 2 that employs the delta arrangement, the same subtractive color processing as that in the third embodiment is carried out. Concretely, if the signal 6 instructs the driving of the liquid crystal display panel 2 that employs the delta arrangement, the switch 78 outputs the value of the lower-order bit Dhk output from the determination circuit 75 to the addition circuit 76. In this case, the operations of the R weighting circuit 72R, G weighting circuit 72G, and B weighting circuit 72B are the same as those in the third embodiment.

On the other hand, if the panel configuration change signal 6 instructs the driving of the liquid crystal display panel 2 that employs the stripe arrangement, the general error diffusion processing is carried out. Concretely, if the signal 6 instructs the driving of the liquid crystal display panel 2 that employs the stripe arrangement, the switch 78 outputs the value of the lower-order bit Dh1*k* supplied from the error diffusion processing circuit 61 to the addition circuit 76. As to be understood from FIG. 21, the lower-order bit output Dh1*k* is the same as the carry output generated by the general error diffusion processing, so that the subtractive color image data Dfrck generated by the addition circuit 76 and by the overflow processing circuit 77 respectively also comes to match with the subtractive color image data obtained through the general error diffusion processing carried out for the input image data Dink.

According to the LCD driver 3C configured such way in this fourth embodiment, it is possible to carry out the subtractive color processing effectively so as to keep the image quality favorably regardless of whether the liquid crystal display panel 2 employs the stripe arrangement or stripe arrangement.

While the preferred form of the present invention has been described, it is to be understood that modifications will be apparent to those skilled in the art without departing from the spirit of the invention. For example, the initial value generated by the initial value setting circuit, as well as how to change the initial value can be varied freely. Furthermore, although the panel configuration change signal 6 is supplied from the image drawing circuit 4 to the LCD driver in the second and fourth embodiments, the signal 6 can also be supplied to any of the LCD drivers 3A and 3C by connecting an external input pad of the LCD driver to a signal line that has a fixed potential (e.g., any of a power supply potential and a ground potential). Which of the stripe arrangement or the delta arrangement is to be employed for the liquid crystal display panel 2 is already determined when the LCD driver is installed in the liquid crystal display panel 2, so that the signal level of the signal 6 may be fixed.

Furthermore, although each of the above embodiments discloses a liquid crystal display apparatus provided with an LCD (liquid crystal display) panel, the present invention may also apply to a display apparatus provided with any other display panel that employs the delta arrangement (e.g., a plasma display panel).

It is apparent that the present invention is not limited to the above embodiments, but may be modified and changed without departing from the scope and spirit of the invention.

What is claimed is:

1. A display apparatus, comprising:

a display panel having a plurality of pixels, each of the pixels including a plurality of sub-pixels disposed according to a delta arrangement;

a subtractive color processing circuit generating subtractive color image data in a response to input image data indicative of a gradation associated with the sub-pixels; and a driving circuit driving the display panel in a response to the subtractive color image data, wherein the subtractive color processing circuit performs an error diffusion processing and a weighting processing for the input image data, in which the weighting processing is performed to increase or decrease a value of the subtractive color image data according to a line including a sub-pixel subjected to the subtractive color processing, wherein a value of the subtractive color image data corresponding to a sub-pixel which belongs to a first line increases upon displaying a frame, and a value of the subtractive color image data corresponding to a sub-pixel which belongs to a second line adjacent to the first line decreases upon displaying the frame, wherein the subtractive color processing circuit includes:

a weighting circuit increasing or decreasing the input image data in a response to the line that includes the sub-pixel subjected to the subtractive color processing, thereby generating a weighted image data; and an error diffusion processing circuit performing an error diffusion processing of the weighted image data, thereby generating the subtractive color image data, wherein the weighting circuit determines the weighted image data that corresponds to the sub-pixel belonging to the first line so that the weighted image data takes a value of the input image data and over, and determines the weighted image data that corresponds to the sub-pixel belonging to the second line so that the weight image data takes the value of the input image data or under, wherein the weighting circuit generates the weighted image data so that an equation "Din−1<(DhA+DhB)/2<Din+1" is satisfied by both a value DhA of the weighted image data corresponding to the sub-pixel belonging to the first line of the value Din of the input image data, and a value DhB of the weighted image data corresponding to the sub-pixel belonging to the second line of the value Din, wherein the input image data comprises m bits data, wherein the subtractive color processing circuit carries out an α-bit subtractive color processing for the input image data, thereby generating the subtractive color image data, wherein the weighting circuit generates (α+1)-bit weighted data Dhlsb [α:0] from a lower-order α-bit Din [(α−1):0] of the value Din of the input image data according to the line that includes the sub-pixel to be subjected to the subtractive color processing, wherein the weighting circuit, if no overflow error occurs in a sum of the Din [(m−1):α] and Dhlsb [α:0], determines a value Dh of the weighted image data with a use of an equation "Dh=Din [(m−1):α]+Dhlsb [α:0]" and if an overflow error occurs in the sum, the weighting circuit determines the value Dh of the weighted image data as "all−1", and wherein the value Din [(m−1):α] means data in which an upper-order (m−α) bit matches with an upper-order (m−α) bit of the value Din of the input image data and the lower-order α bit is "all−0".

2. The display apparatus according to claim 1, wherein the lower-order α-bit Din [(α−1):0] matches with an average value between the weighted data Dhlsb [α:0] determined for the first line with respect to a value of the lower α-bit Din [(α−1)] of the value Din of the input image data and the weighted data Dhlsb [α:0] determined for the second line with respect to the value of the lower α-bit Din [(α−1):0].

3. The display apparatus according to claims 1, wherein the error diffusion processing circuit performs the subtractive color processing for the weighted image data subjected to a k-bit and selects an initial error value used in the error diffusion processing from even numbers within 0 to $2^k-2$.

4. The display apparatus according to claim 3, wherein the error diffusion processing circuit changes the initial value for every other line.

5. The display apparatus according to claim 1, wherein the weighting processing disposes a first group of the sub-pixels and a second group of the sub-pixels alternately between adjacent lines that include the sub-pixels, the first group of the sub-pixels having a higher luminance than the second group of the sub-pixels.

6. The display apparatus according to claim 1, wherein the weighting processing increases a luminance of a first group of the sub-pixels in the line and decreases the luminance of a second group of the sub-pixels in another line to balance a bias of luminance among the sub-pixels.

7. The display apparatus according to claim 1, wherein in the delta arrangement, each of the sub-pixels is positioned farther from a same color sub-pixel on a same line than a same color sub-pixel disposed adjacently in a vertical direction of an arrangement of the sub-pixels.

* * * * *